US005209538A

United States Patent [19]

Gabruel

[11] Patent Number: 5,209,538

[45] Date of Patent: May 11, 1993

[54] AUTOMATICALLY ACTUATED, AUTOMATICALLY-ADJUSTABLE CARGO AND PERSONNEL SCOOPING AND REALEASING APPARATUS

[76] Inventor: Edwin Z. Gabruel, 91 Mt. Tabor Way, Ocean Grove, N.J. 07756

[21] Appl. No.: 795,938

[22] Filed: Nov. 18, 1991

[51] Int. Cl.[5] ..... B66C 1/38

[52] U.S. Cl. ..... 294/118; 294/82.32; 294/119.3

[58] Field of Search ..... 294/118, 82.32, 110.1, 294/68.23, 98.1, 902, 119.3; 5/81.1, 83.1, 89.1, 628

[56] References Cited

U.S. PATENT DOCUMENTS

| | | | |
|---|---|---|---|
| 1,981,666 | 11/1934 | Ridley | 5/81.1 X |
| 2,416,568 | 2/1947 | Blenden | 294/82.32 X |
| 3,219,382 | 11/1965 | Hugentobler | 294/98.1 |
| 3,716,264 | 2/1973 | Pearne et al. | 294/98.1 X |
| 4,093,298 | 6/1978 | Gatewood | 294/118 |
| 4,509,785 | 4/1985 | Van Raemdonck et al. | 294/118 |
| 4,678,220 | 7/1987 | Gabriel | 294/118 |
| 4,790,587 | 12/1988 | Stoll | 294/98.1 |
| 5,060,324 | 10/1991 | Marinberg et al. | 5/81.1 |
| 5,074,608 | 12/1991 | Gabriel | 294/118 X |

*Primary Examiner*—Margaret A. Focarino

*Assistant Examiner*—Dean J. Kramer

[57] ABSTRACT

This apparatus is a tongs-like device for automatically loading and unloading containerized cargo, comprising two elongated member pivoted at a selected distance from the device's top with a pivot pin. Its lower portions are vertical to enable it to hold a containerized load in place. Its weight distribution between its upper and lower portions is such that its lower portions will separate automatically at touchdown. The inside surfaces of its lower portions may have teeth for securely grabbing onto the load. Extension springs may be added between upper and lower portions to aid in helping the device to automatically disengage the load. Horizontal hammerheads provided near its top receive all or most of the horizontal stresses imposed on the apparatus, reducing the amount of pressure against the sides of the containerized load. The apparatus is then modified using inflated pillows to include the rescue of personnel as well as for loads of various sizes and shapes. Furthermore, electromagnets and/or crossbars can provide positive, secure load retention. By using partioned double pillows on each of the lower portions' inside wall, an individual is safely embraced within the apparatus, even if a compartment of a partioned pillow should be accidentally pierced.

18 Claims, 16 Drawing Sheets

50'

FIG. 34
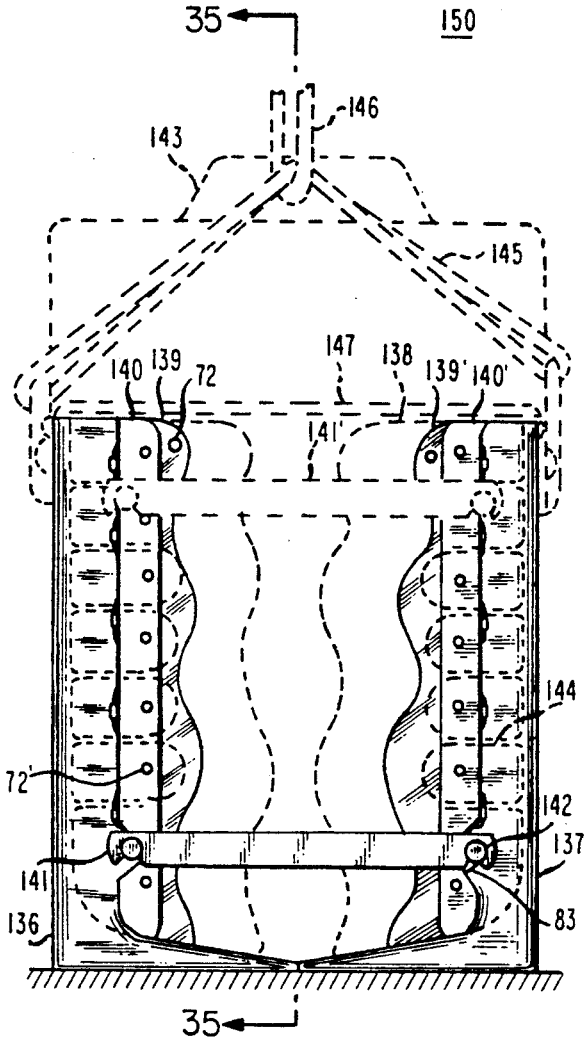
FIG. 35
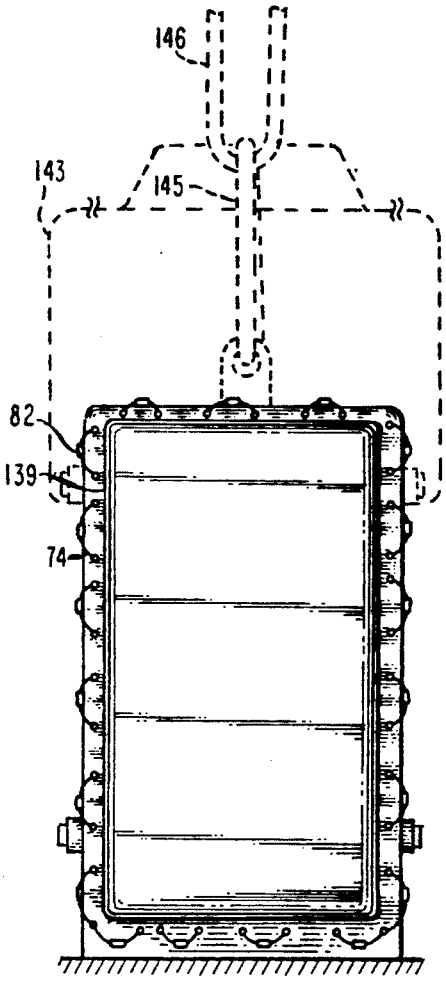
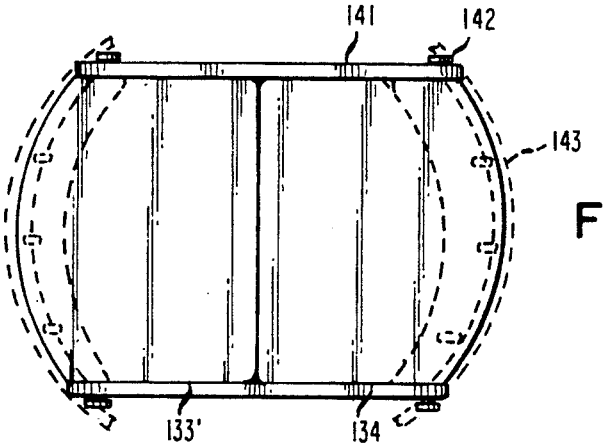
FIG. 36

AUTOMATICALLY ACTUATED, AUTOMATICALLY-ADJUSTABLE CARGO AND PERSONNEL SCOOPING AND REALEASING APPARATUS

BACKGROUND OF THE INVENTION

This invention is in the field of material handling, primarily related to the lifting and transporting of containerized cargo. Personal are included. A previous U.S. Pat. No. 4,678,220, dated Jul. 7, 1987, by Gabriel, also describes such a tongs-like lifting device for automatically loading and unloading containerized cargo. This invention has many improvements over the shovel-like device described in the previous patent. The weaknesses in the previous patent are overcome in this application. The improvements include hammerheads at the upper portions of the device for sustaining high horizontal forces produced by the cargo's weight; an extension spring to reduce the magnitude of the weights on top for automatic disengagement upon the load's touchdown; provision for using various size containerized loads by adding spacers or inflated pillows to the inside walls of the lower portions, and using a load with indentations at its bottom to accommodate the projections with sharp ends at the bottom end of the lower portions for scooping up the load.

In this design the entire cargo is scooped up by the apparatus instead of by a load cable. One should be reminded that sometimes loads do not have cables provided for a hook to attach to. When might such a cableless load occur? Such a situation might occur when trucks with loads are involved in highway accidents, in factory fires involving drums of toxic or hazardous materials, when ammunition boxes need to be moved without the presence of personnel at the scene, and in other cases when loads need to be moved and it is inconvenient to tie a cable to the load.

The shape of the lower portions could be made circular to enable cylindrical drums to be scooped up more easily and held in position. The teeth along the inside surfaces of the lower portions may be made blunt so they would not dig into a cylindrical load, causing possible damage to the container. Personnel also may be scooped up.

No such cargo handling apparatus is known to the applicant, with the improvements described in this application.

SUMMARY OF THE INVENTION

This is a multi-purpose cargo and personnel lifting apparatus with automatic loading and unloading capability. Because of its ability to scoop up the entire load, irrespective of its shape and size within limits, this apparatus can be utilized by the military for rescue missions of personnel in inaccessible places, such as in enemy territory, mountainous regions, rough seas and oceans, roofs of burning buildings and from areas where poisonous gas is used or has been used.

This apparatus can be used to scoop up hazardous and toxic waste materials in containers without ground personnel present. It may be used to scoop up ammunition in boxes. It may be used to extinguish localized fires by directing the apparatus over the fire and allowing its lower portions to open directly over the fire, emptying its fire-extinguishing substances.

This apparatus comprises two elongated members somewhat curved toward each other at its bottom and pivoted near its top. The apparatus has hammerheads attached to its upper portions, positioned to receive all of the horizontal stresses imposed, so that no horizontal stress is borne by its lower portions which hold and support the load. Because of the apparatus' distribution of weight, with weights on top and with the possible assistance of an extension coil spring, the device's lower portions close automatically because of the horizontal component of tension in the hoist cables.

The specification describes different versions, such as for lifting containerized cargo of a specified size, also for lifting cargo of various shapes and dimensions by the added use of inflatable pillows which automatically adjust to the size and shape of the cargo, by maintaining a predetermined preset air pressure. For heavier loads the air pressure would be set at a higher value, in order to securely hold the load in place. Not as much air pressure may be needed for a relatively light load. In addition, a version is shown which is capable of snatching up an individual into its lower portions' space. In this version, the inside exterior surface of each pillow may have waves or troughs and crests to comfortably accommodate an individual either lying down, sitting up or standing on two padded extensions or projections from the bottom of the lower portions. These projections could be made very thin to be better able to scoop up a light load or an individual lying down or sitting. The same pillow shapes may be suitable for holding cargo of various shapes and sizes securely in place. Double pillows and pillows with partions are shown to provide greater personnel security.

The apparatus shown may be modularized, so that certain common parts may be used for all versions described herewith, thus reducing the amount of inventory, and also enabling one to reduce its physical size when disassembled for storage say in the cargo-hold of an aircraft or even in its passenger compartment. Finally, an overall smaller version has been introduced requiring no pivot pin or upper portions. In this version, rotor blades and an engine may be added to propel the apparatus to a desired location. Thus, hoist cables could be eliminated.

In conclusion, this apparatus meets a need in the military and in industry simply and inexpensively, in which a vacuum now seems to exist.

BRIEF DESCRIPTION OF DRAWINGS

For the purpose of illustration, the following drawings show forms which are presently preferred. It should be understood, however, that this invention is not necessarily limited to the precise arrangement, instrumentalities and field of utility as therein demonstrated.

FIG. 34 is a front view assembly of the apparatus shown in FIG. 29 but without the upper portions and without the pivot pin. It has the appearance of a cage or elongated basket. Either hoist cables are attached at its top end, shown by dashed lines, or a rotor and engine may be attached, also shown by dashed lines. The two lower portions are held together by cross-piece members. Both members are used when hoist cables are used. Only the lower cross-piece member is necessary when a rotor and engine are attached at the top of the two portions. When the compartments of the inside pillows are inflated, with sufficient pressure, some of the compartments inflated could bulge into the outside pillows, as shown in dashed lines.

FIG. 35 shows a sectional view taken along line 35—35 of FIG. 34.

FIG. 36 is a bottom view of the assembly shown in FIG. 34, showing the two bottom extensions making contact with each other.

DESCRIPTION OF A PREFERRED EMBODIMENT

Figure 2:
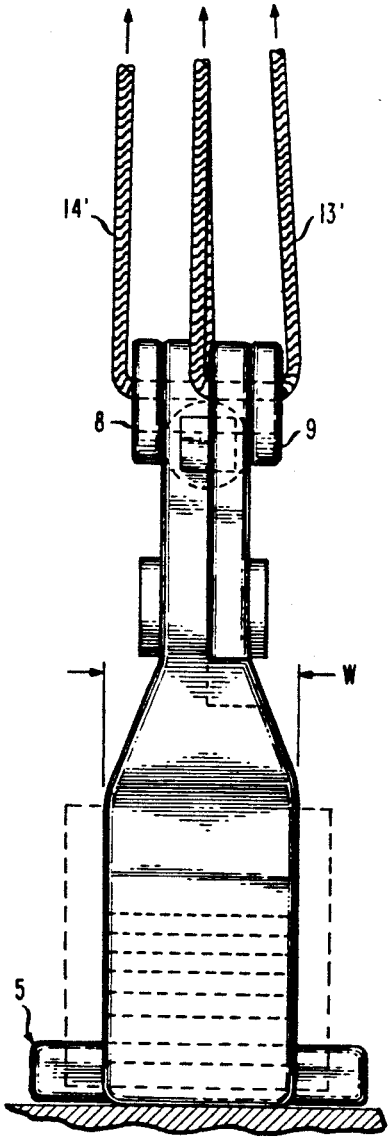
FIG. 2 shows the side view thereof.
Figure 1:
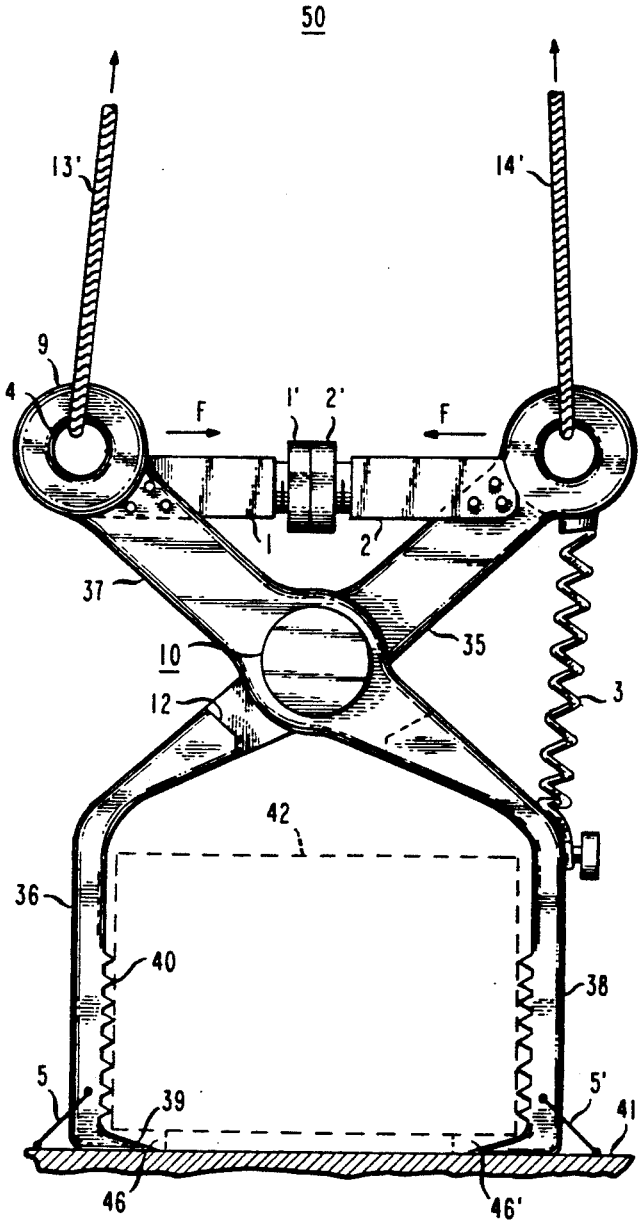
FIG. 1 shows the front view of a tongs-like cargo lifting device with the containerized load that is rectangular in shape. Its lower portions are engaging a rectangular load and are shaped vertically flat inside.

An embodiment of a load-lifting apparatus or device 50 is portrayed in the assembly drawings of FIGS. 1 and 2. Note that with pivot pin 10 and upper and lower portions 35, 37 and 36, 38 respectively, apparatus 50 resembles ice tongs in its shape and performance, with some noteworthy deviations. The device is shown with hoist cables 13' and 14' attached to holes 4 and 4', although various types of fittings could be added and attached to the holes by the user, then cables 13' and 14' could be attached to the fitting selected, such as shackles. The deviations from ice tongs include hammerheads 1' and 2', enlarged width W, FIG. 2, spring 3 and weights 8 and 9, if used.

Lower portions 36 and 38 are rectangular-shaped with a sharp-ended protrusions or projections 39 and 39' at its bottom. Container 42 in dashed lines makes contact with slab or riser 43 and is held in place with the assistance of dull teeth 40 along the inside surfaces of lower portions 36 and 38. Because of recesses 46 and 46', protrusions 39 and 39' are able to extend under container 42 and help retain it when hoist cables 13' and 14' lift device 50 vertically; closure pressure on container 42 by lower portions is produced by horizontal components of force F, FIG. 1. For ease in snatching container 42, it would be preferred that the container itself have recesses 44 at its bottom to accommodate protrusions 39 and 39'. Container 52 shows recesses 53.

When device 50 is later lowered at another site, making contact with another rigid surface, lower portions 36 and 38 will separate automatically, assuming container 42 has recesses at its bottom, because of the horizontal structural stress components in the upper portions produced by the tensions on cables 13' and 14' are significantly reduced, thus allowing container 42 to be discharged and removed, if desired. After lower portions 36 and 38 are separated, device 50 could be moved sideways, away from container 42 by hoist cables 13 and 14, so as not to reload the same container.

Figure 3:
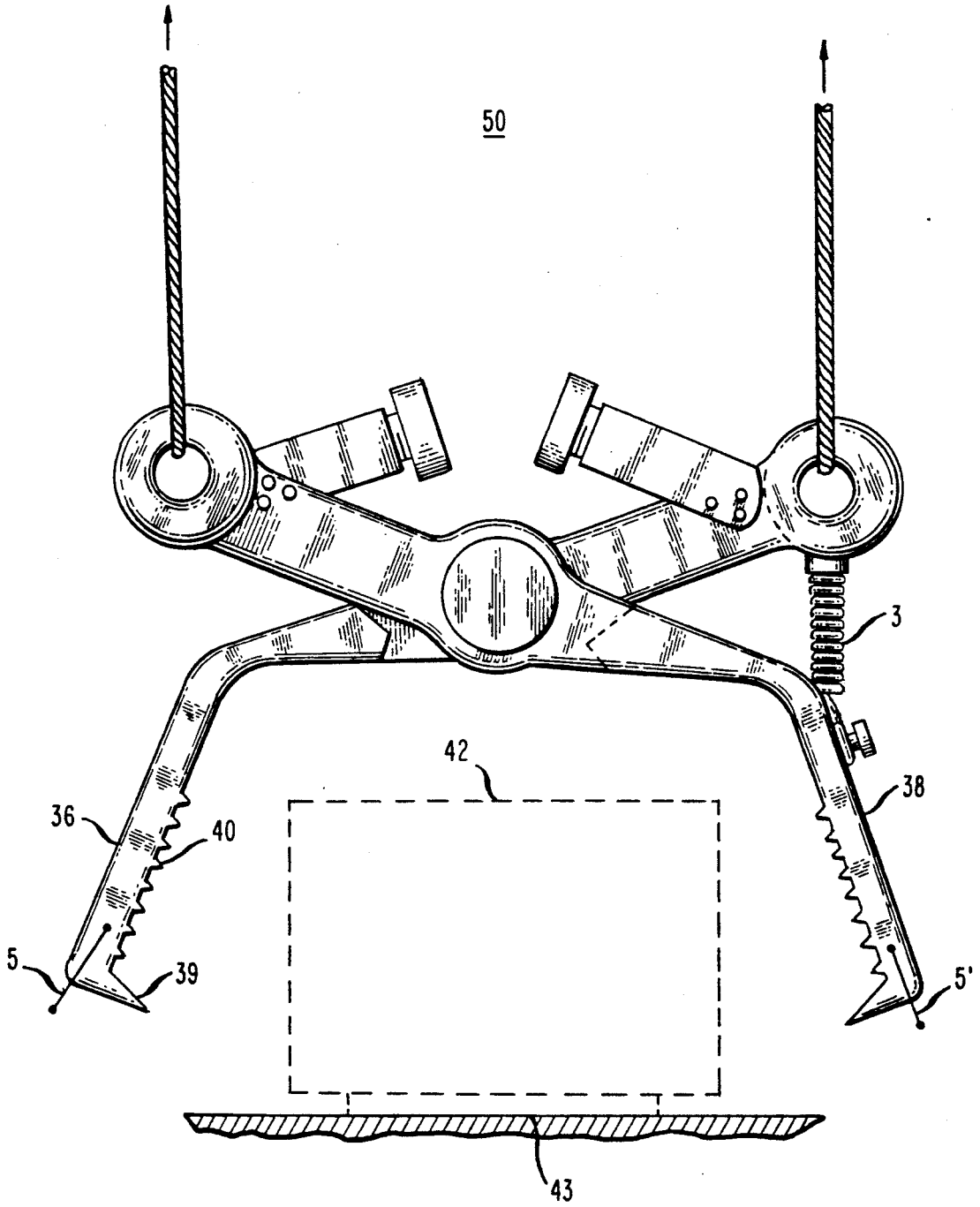
FIG. 3 shows the front view of the same tongs-like cargo lifting device, with its lower portions disengaged from the containerized load.

Device 50 can then be reused to scoop up another container for transportation elsewhere. FIG. 3 shows device 50 with lower portions separated. Wire brackets 5 and 5' help keep the apparatus upright on a supporting platform, by providing supplementary stabilization.

Figure 5:
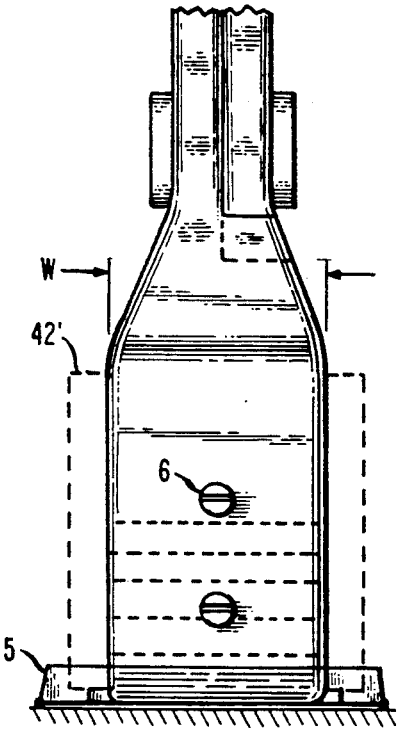
FIG. 5 shows a side view thereof.
Figure 4:
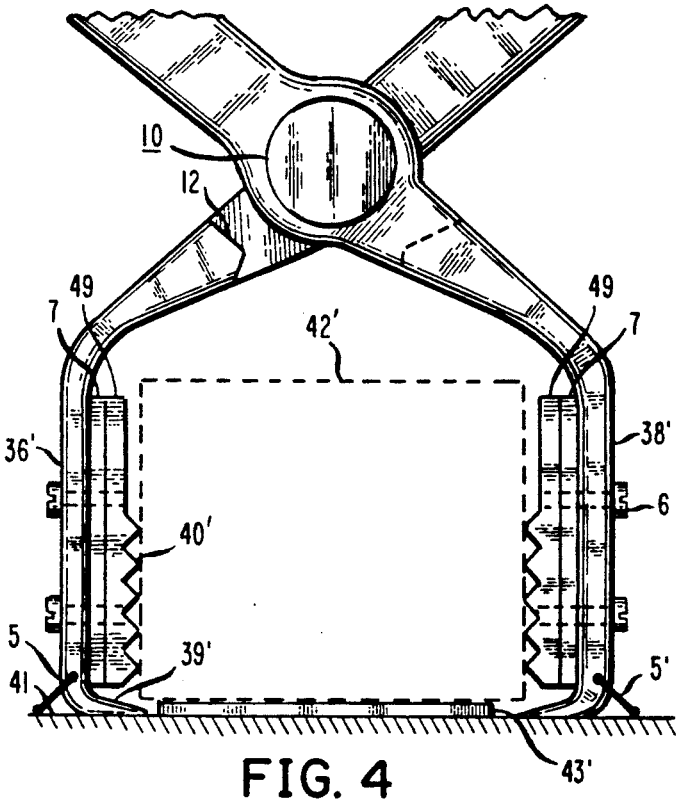
FIG. 4 shows a partial front view of the tongs-like lifting device with a smaller size containerized load and spacers along the inside walls of the device's lower portions.

The apparatus 50', shown in FIGS. 4 and 5, is identical to apparatus 50 except for the inside walls of lower portions 36' and 38'. To accommodate smaller container 42', spacers 7 have been added to the inside walls of the lower portions. Now teeth 40' could be added to the inside surface or wall of spacer 7, or teeth 40' could be added to another spacer 49. Additional spacer 49 with teeth on one side would permit less expensive spacers of various thicknesses to be inserted between walls of lower portions 36' and 38' and spacer 49, instead of having a different slab with teeth on one side being fastened to the inside wall for each different size container. Container 42' has width indicated in dashed lines, FIG. 5. Spacers 7 and 49 have widths W, although wider spacers could be used. Spacers are fastened to the inside walls of lower portions 36' and 38' by machine screws 6. FIGS. 4 and 5 are not shown to scale. FIGS. 4 and 5 are shown partially as the device's upper portions are essentially identical to FIGS. 1 and 2. Wire bracket 5 helps keep apparatus upright.

Figure 6:
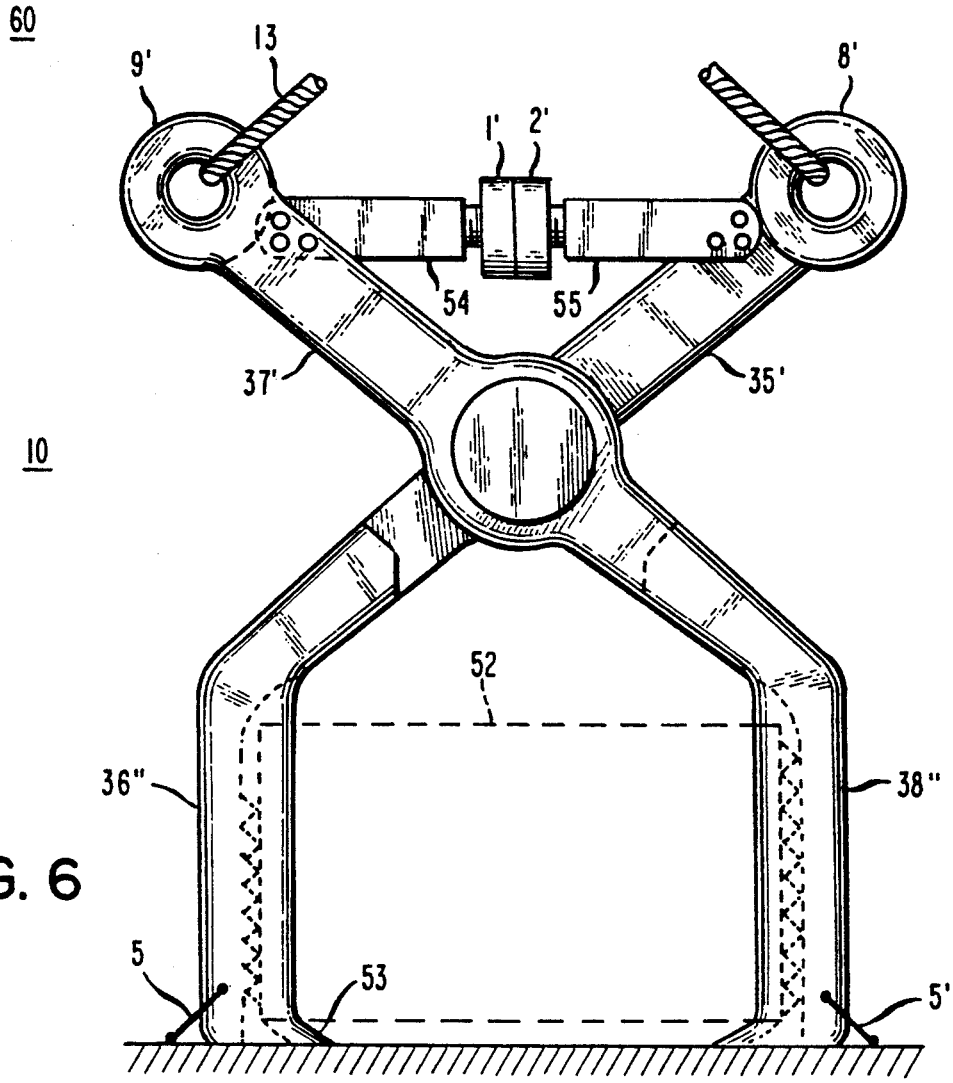
FIG. 6 shows the front view of a tongs-like cargo lifting device with a cylindrical containerized load, and with the device's lower portions curved to accommodate the cylindrical shape of the load.
Figure 7:
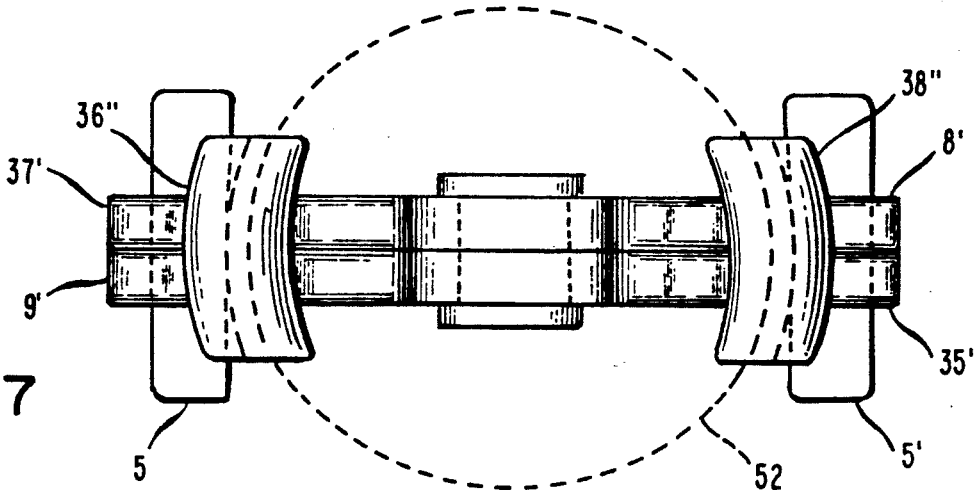
FIG. 7 is a bottom view thereof showing the curvature of the lower portions.

Apparatus 60, shown in FIGS. 6 and 7, is identical with apparatus 50, except for the lower portions 36" and 38". These lower portions are shown to be circular in botton view, FIG. 7. Many containers are cylindrical in shape. A circular-shaped inside surface can hold circular containers more securely than rectangular-shaped lower portions. As in FIGS. 4 and 5, circular spacers could be added to accommodate smaller cylindrical containers. Spacers and toothed additions, similar to member 40', FIG. 4, could be held in place by machine screws, as in apparatus 50'. Container 52 is shown with beveled bottom corners to provide recesses for the sharp extensions protruding from the bottoms of lower portions 36" and 38". Note that in bottom view, FIG. 7, container 52 is shown to be cylindrical in shape.

Figure 9:
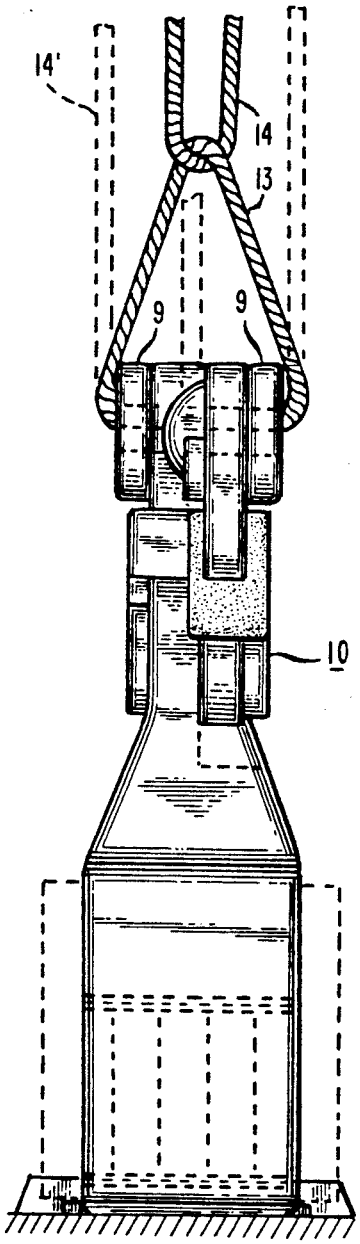
FIG. 9 shows a side view thereof.
Figure 8:
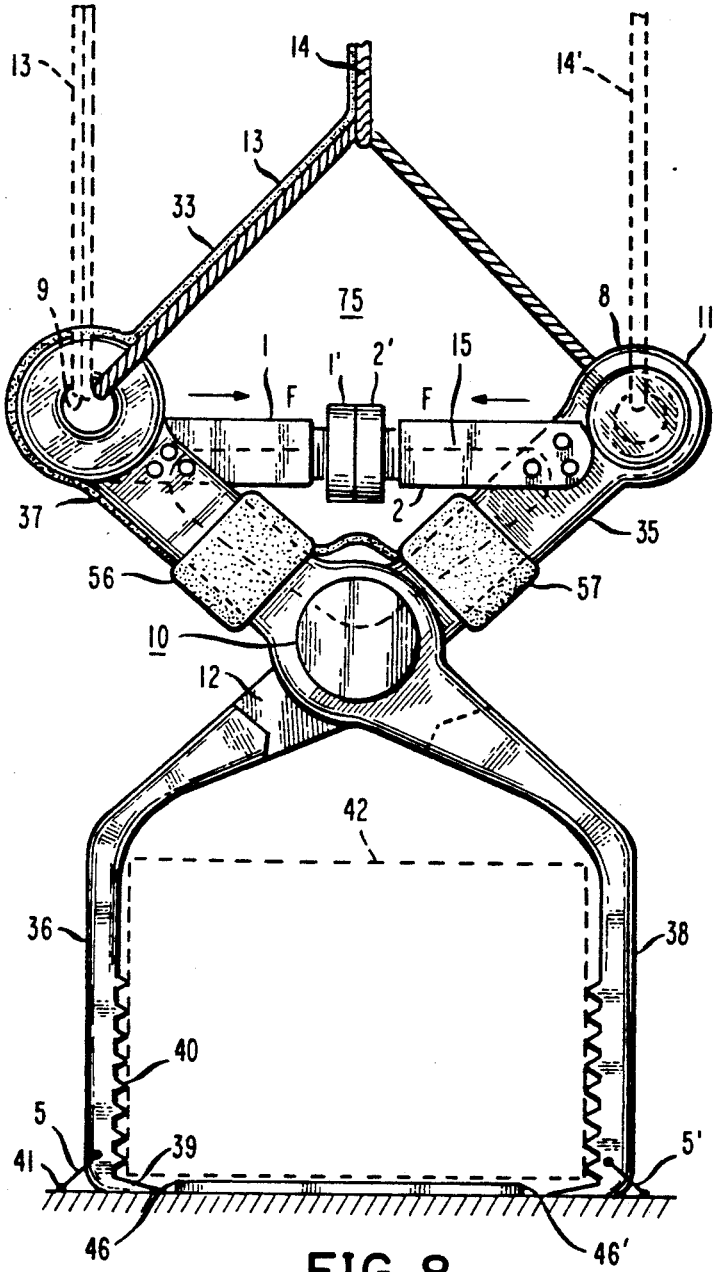
FIG. 8 shows the front view of the apparatus with electromagnets added to the upper portions to provide positive load retention.
Figure 10:
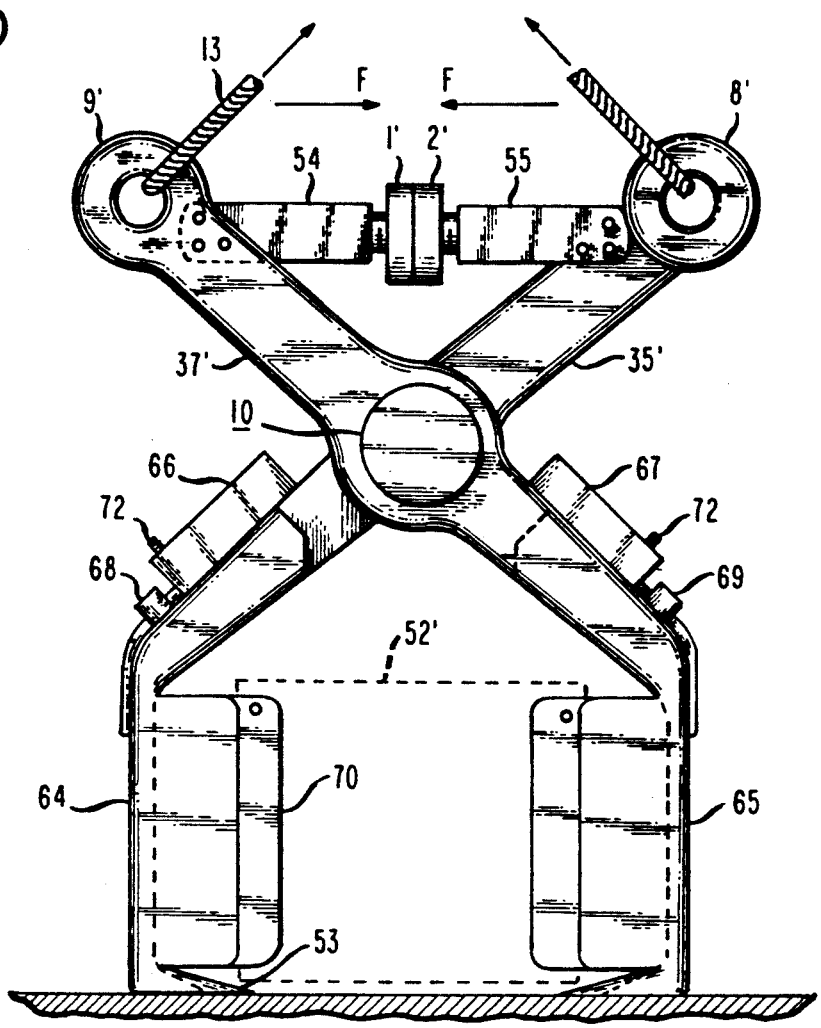
FIG. 10 shows a schematic diagram of the wiring for the two electromagnets to provide positive load retention.

In FIGS. 8 and 9, front and side views of apparatus 75 shows coils 56 and 57 added to upper portions 37 and 35, respectively. This apparatus is identical to apparatus 50 except for omission of spring 3, and the two coils addition of 56 and 57. It is assumed that upper portions of apparatus 75 including bars 1 and 2, hammerheads 1' and 2' and pivot pin 10 are magnetizable steel so that magnetic path 15 makes a closed loop, when DC voltage is applied to coils 56 and 57 via wires 33 following hoist cables 13 and 14. If high strength ferrous steel is used for the apparatus' fabrication, then AC voltage needs to be applied first to reduce the residual magnetism in the steel prior to application of DC voltage, via double-pole, double-throw switch 31, FIG. 10. FIG. 10 shows the schematic diagram for the two coils 56 and 57. LEDs 59 are to be located, one on each side, of apparatus 75. The LEDs illuminate when DC voltage 62 is applied via resistors 35. Switch 58 may be located at the apparatus' location, while switch 31, DC source 62, AC source 34 and switch 63 may be located either in the helicopter cockpit or in the operator's cabin of a derrick. Wire bracket 5 helps keep apparatus upright.

Wires 32 from double-throw switch 31 run to 2-way, 3-wire switch 63, then to 2-way switch 58, before becoming two-wires 33, when they are applied to coils 56 and 57. The coils are wrapped around upper portions 35 and 37. When insulated wires are wrapped around steel members, coils become electromagnets, when excited, producing lines of magnetic force in a closed path. When switch 31 is in an open position, as shown, or when AC is introduced via source 34, magnetic lines are not formed. Strong magnetic lines are formed when hammerheads are in contact, enabling a closed steel loop to be formed, when DC voltage is applied. Then positive load retention occurs, preventing the lower and upper portions to separate, until either switch 58 or switch 63 is toggled. If high strength magnetizable steel is used in path 15, then switches 31 and 63 should be set to allow AC voltage to be applied to coils 56 and 57 momentarily, to reduce the residual magnetism in magnetic path 15. Wire brackets 5 and 5' help keep apparatus 75 upright.

DESCRIPTION OF ANOTHER PREFERRED EMBODIMENT

Figure 11:
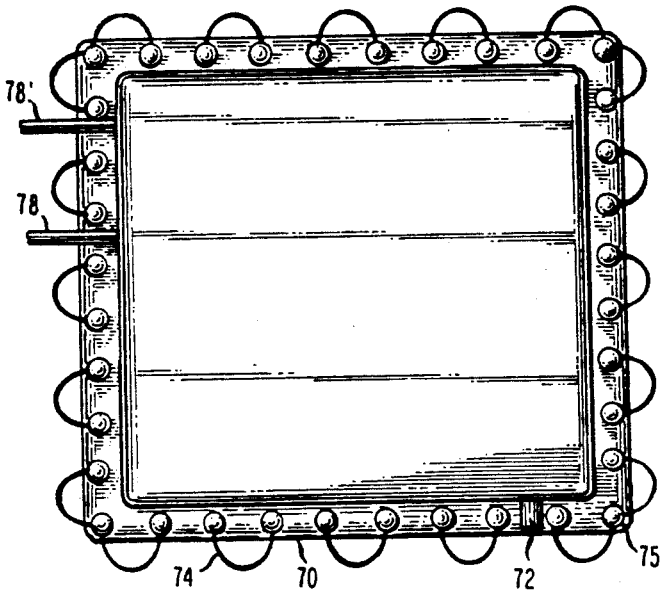
FIG. 11 is a front view of a typical pillow with exterior loops; the pillow to be supported by the inside surface of the lower portion of the apparatus.
Figure 11A:
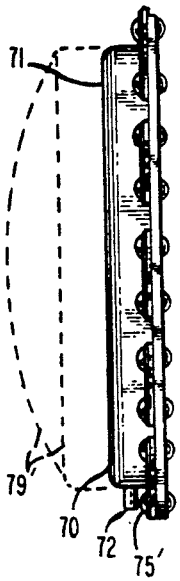
FIG. 11A is a side view thereof. Dashed lines show the inflated pillow.
Figure 12:
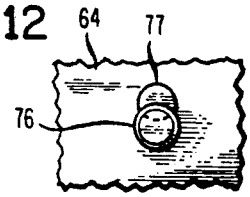
FIG. 12 is a front view of a button with a standoff to enable mounting a loop on the pillow's periphery.
Figure 16:
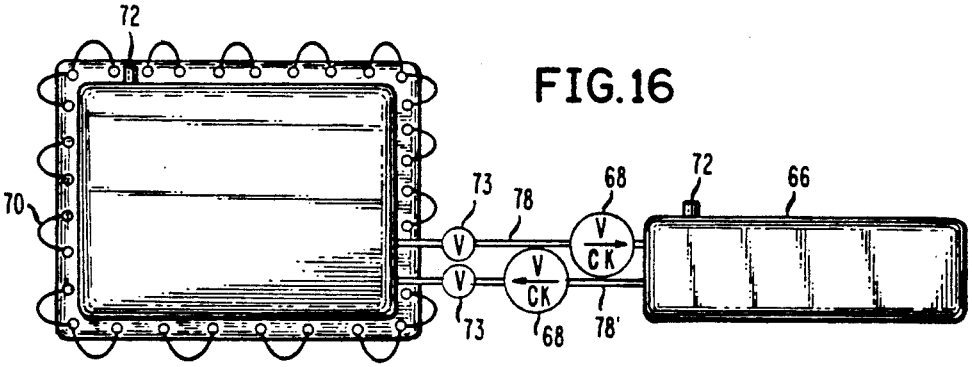
FIG. 16 shows an exterior tank with pressurized air, connected via gate and check valves to the pillow shown in FIG. 11.

Cargo hook apparatus 90 is an improved, preferred design over the previously described cargo-scooping devices including apparatus 80, in this application. It is capable of automatically lifting containerized cargos of various sizes and shapes within limits. For light-weight loads, high-impact, fiber-reenforced parts may be used. For heavy load, high-strength aluminum, steel and/or titanium parts are suggested for the apparatus itself. Steel is the least expensive and the heaviest of the metals suggested. The main difference between this design and the previous designs is the pillow or mattress-like inflatable bag 70. FIG. 18, fastened to the inside surface of each of two lower portions 64 and 65. The air pressure within the pillows, being maintained at a pre-set pressure, enables the pillows to adapt to accommodating various size and shapes of loads. The pillow may be fastened to the inside surface of 64 or 65 by either elastic or nonelastic loops 74, FIG. 11, or by other types of quick disconnect fasteners, such as the Dzus fastener, not shown. Hook 83, FIG. 17, would be the least expensive, safe method. The pressure needed in pillow 70 would depend on the weight of the load and possible its shape and contents, too. For a very heavy load, an air pressure of b 20 psi may be required. For a light load only 2 psi may be required and sufficient, to snugly embrace the package. To assist in retaining the cargo in place, exterior surface 71 of pillow 70 may need to be coarse, like sandpaper or plastic-beaded, to prevent the load from slipping off. Loops 74 along the perimeter of pillow, shown in FIG. 12, could be hooked on to stand-off members shown in FIGS. 12 and 13, each with a stud for fastening onto the perimeter of each lower portion, as shown in FIGS. 11 and 11A. There could be 20 stand-off members 77 for the 20 loops shown in FIG. 11. Using elastic loops 74, one could stretch each to loop around and embrace each stand-off member 77. When using hook 82, FIG. 17, loops 74 need not be as elastic, because loop 74 cannot come off because of retaining spring 83, FIG. 17. To assist in providing the desired air pressure in pillow 70, for the weight of cargo, to be scooped onto apparatus 80, air pressure tank 66 is suggested, connected to enclosure or pillow 70 by means of tubing 78 and 78', FIG. 16. As an example as to how the tank would assist, assume that initially 5 psi air pressure existed in pillow 70, and that 10 psi is desired for the weight of cargo to be scooped up. The tank's air pressure may be 40 psi. Valve 73' is slowly opened until pressure gage 79 reads 10 psi, then valve is closed. If the air pressure in pillow is too high and needs to be reduced to, say, 10 psi from 15 psi, and the tank air pressure is lower, say, 10 psi, valve 73 would be opened momentarily until the pillow pressure drops to 10 psi. Check valves 68 and 68' permit air to flow only in one direction. To add or remove air from either pillow 70 or tank 66, Dill air valves 72 are provided. Air valves 72 permit air to be pumped into the tank and/or the pillow initially, too, when first installed or at any other time. If it is desirable to equalize air pressures in pillow 70 and tank 66, both valves 73 and 73' would be opened, then closed. Valves 73 and 73' are needed, too, should there be an air leak in tubing 78 or 78' or in tank 66, perhaps at valve 72. Should the air leakage occur in the pillow part, valves 73 and 73' could still be closed to preserve air pressure in tank 66 until the air leak in the pillow portion can be located and sealed. Gage 79 attached to pillow 70 would indicate the occurrence of air leakage. Similarly, gage 81 on tank 66, when indicating a dropping of pressure would indicate a leak; then valves 73 and 73' should be inspected and tightened for closure. Leakage elsewhere also could be the problem. Pillows 70 could be partially or fully inflated or they could be inflated at the desired pressure at the time of picking up a load, to conserve on the air supply as there could be a slight leak somewhere in the pillow system which, of course, would be undesirable, but possible, like air leakage from auto tires.

There are pressure sensors that can automatically vary the opening of a valve to allow air pressure from tank 66 to enter pillow 70, or for higher pressure from pillow to enter tank 66. An air relief valve 84 could be provided for enclosure or pillow 70 to prevent its pressure to exceed its maximum permissible design value. Depending on the pillow, too much pressure in side pillow could damage it.

Figure 13:
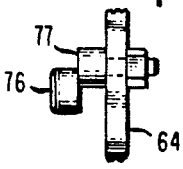
FIG. 13 shows a side view thereof.
Figure 17:
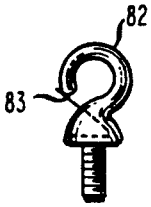
FIG. 17 is an off-the-shelf hook with a retention leaf spring, as a simple substitute for the standoff button of FIG. 12.
Figure 14:
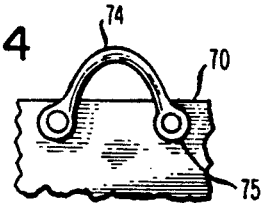
FIG. 14 is a front view of a typical loop.
Figure 15:
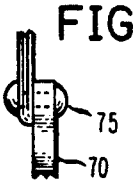
FIG. 15 is a side view thereof.
Figure 18:
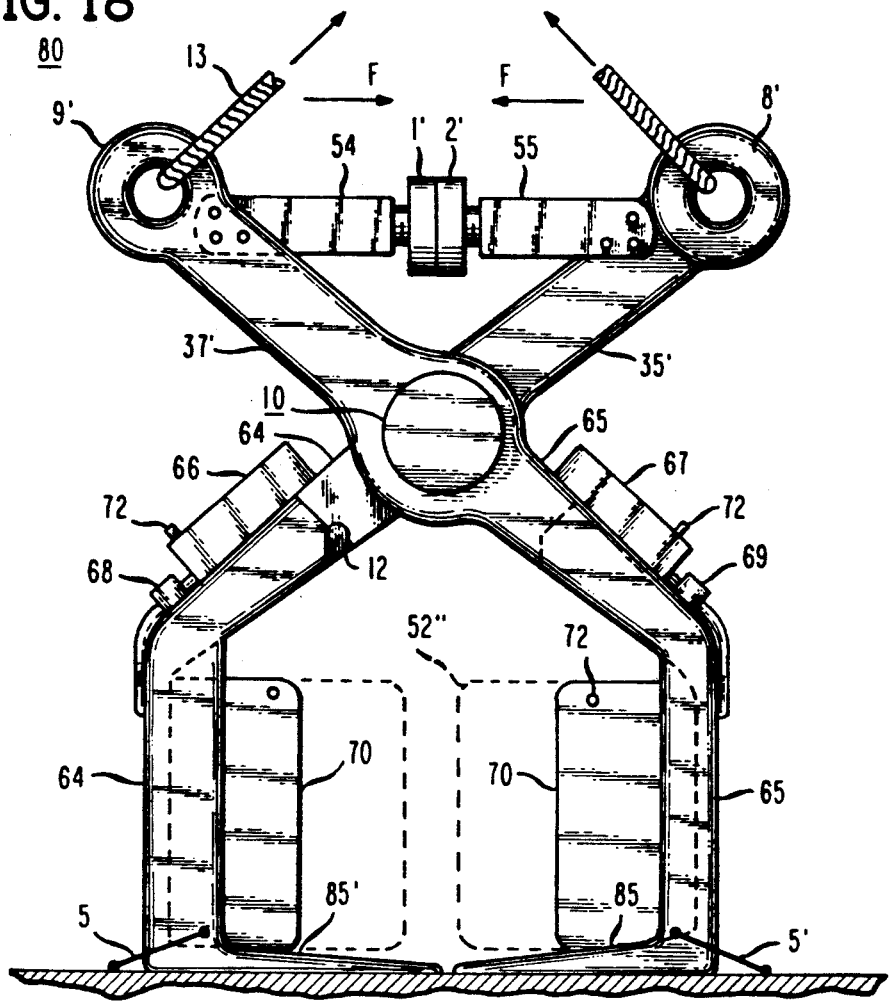
FIG. 18 is a front view of a tongs-like cargo lifting apparatus with inflatable pillows mounted on the inside surfaces of its lower portions.

As an alternate technique for fastening pillow 70 to either portion 64 or 65, steel hook 82, FIG. 17, with keeper leaf spring 83, may be substituted for standoff member 77, FIG. 13. Safety hooks are supplied by Cries/Dynacast Co., New Rochelle, N.Y. 10802. They come in different sizes. Bracket 5 helps apparatus maintain uprightness upon touchdown.

ANOTHER PREFERRED EMBODIMENT

Apparatus 60 shown in FIGS. 6 and 7 has been modified to scoop up persons automatically from the sea or from inaccessible mountainous areas, without endangering the lives of rescuers. The new personnel designs are shown in FIGS. 18 to 36. With these apparatus a person can be saved without in any way hurting him physically, provided he has not been injured in a fall. Then, because of the inflated enclosure or pillows 52", FIG. 18 and 92, FIG. 22, apparatus 80 and 90, any further injury could be minimized. Resilient extensions of protrusions 85, FIG. 18 are designed to scoop underneath the individual being saved or rescued. Top of protrusions 85 are smooth, polished and slippery, and designed not to hurt even an unconscious individual, provided lower portions 64, 65, and 92, 93 straddle the individual when apparatus 80 and 90 approach him from above. Automatically unloading an individual thus rescued could be performed even more easily if the apparatus makes touchdown on a flat rigid surface. If no flat rigid surface exists, the lower portions 64, 65, and 92, 93 could be separated manually, especially if those portions are constructed of high impact plastic or lightweight titanium. Composite plastics used for auto bodies and aircraft fuselages are both lightweight and strong; they would be good candidates for the construction of these apparatus.

As in FIG. 11, enclosure or pillows 70 are fastened to the inside surfaces of lower portions 64 and 65. Pillows' exterior surfaces 71, FIG. 19, would be smooth, but not slippery so as not to injure the individual being rescued. Inflated pillows 52" and 92, FIG. 22, would conform to the individual's form, thus helping to keep the individual securely and safely in a selected position. For apparatus 80, to protect himself from possible suffocation, a person could hold one hand and elbow to his face to enable breathing freely at all times.

Figure 22:
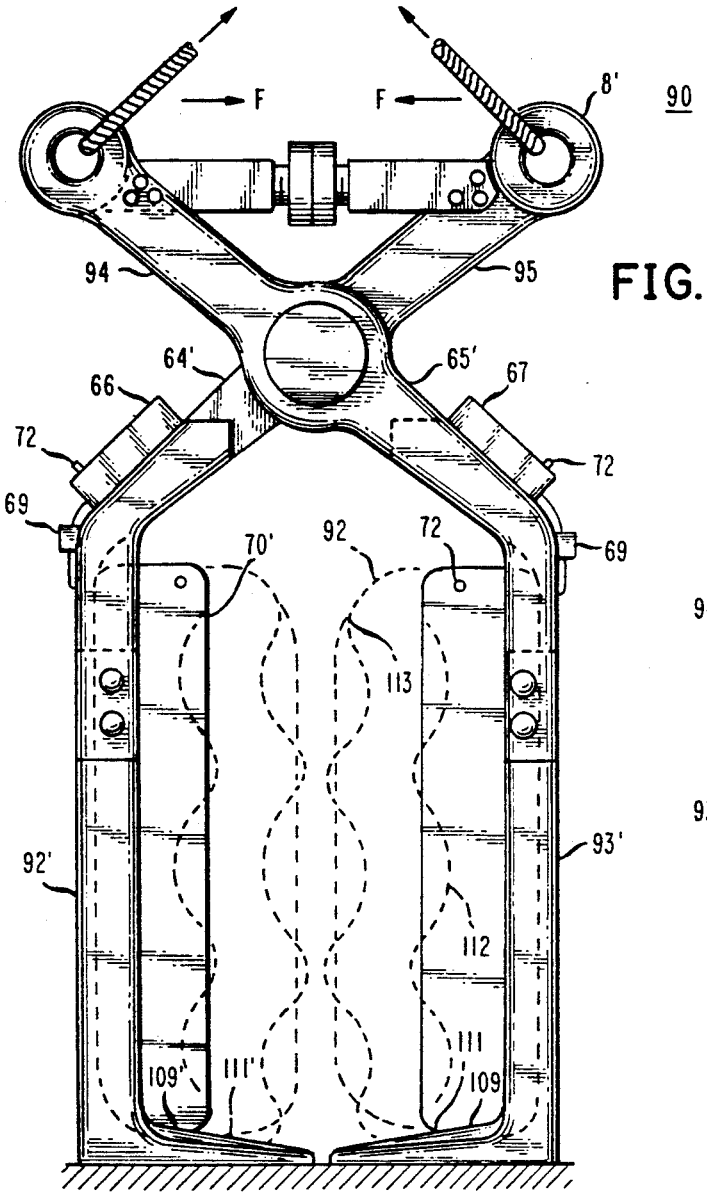
FIG. 22 is a front view of the tongs-like lifting apparatus with automatic loading and unloading capability, showing much longer lower portions to accommodate longer-in-height cargo or personnel who may need to be rescued from dangerous locations. Projections 39 and 39' are capable of supporting container 52.

To keep the weight of apparatus 90 down to a minimum, lower portions 92 and 93, FIG. 22, could be composite plastic, while upper portions 94 and 95, including 64' and 65' could be high strength aluminum. Similarly, in apparatus 80, lower portions 64 and 65 could be composite plastics while upper portions 35' and 37, FIG. 18, could be high strength metal. Brackets 5 and 5' help apparatus maintain uprightness upon touchdown.

Figure 19:
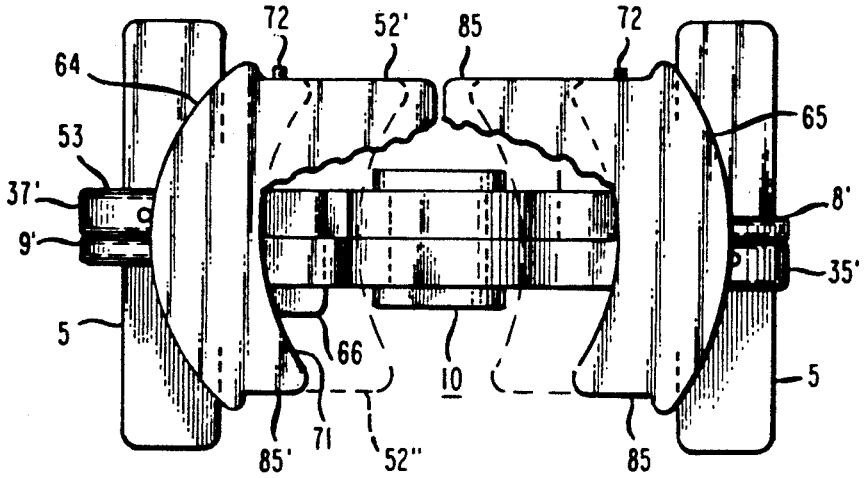
FIG. 19 is a bottom view thereof. The pillows enable various sizes and shapes of cargo to be accommodated within the apparatus' lower portions.

Pivot 10 would still be stainless steel since the pin is supporting the entire weight of both the apparatus and the cargo. The transition between plastics and metal could occur at legs 12 and 12', as indicated in FIG. 18. It should be noted that lower portions 64 and 65, FIGS. 18 and 19, are cylindrically-shaped for better capability of holding and embracing cargo of various shapes.

DESCRIPTION OF AUTOMATIC CONTROL SYSTEM FOR MAINTAINING DESIRED AIR PRESSURE IN PILLOWS

Figure 25:
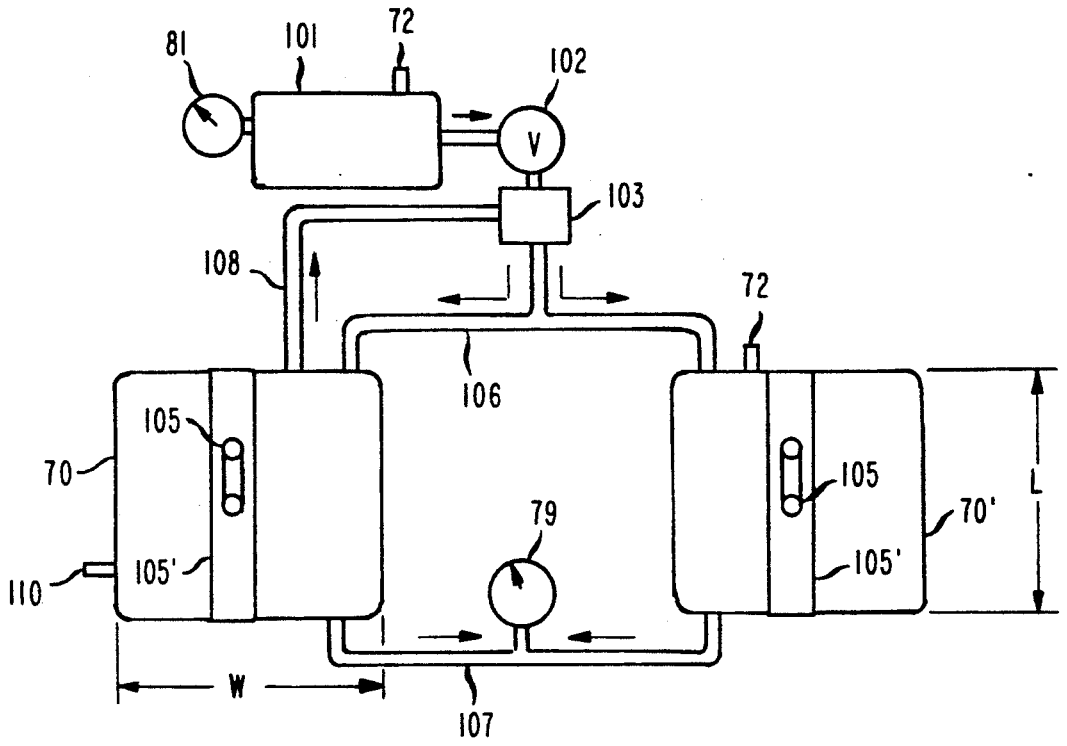
FIG. 25 is a sketch of a technique for maintaining the desired set air pressure in the two pillows, shown in FIG. 22. The tank is connected to the pillows via a gate valve and a pneumatic switching valve. The handles mounted on straps attached to the pillows are for an individual to grasp.
Figure 26:
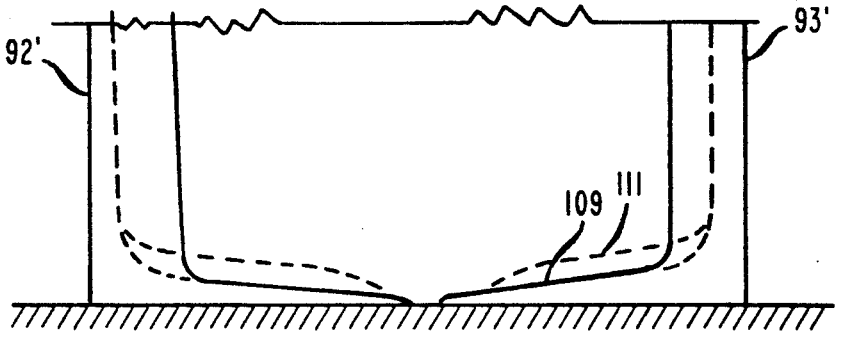
FIG. 26 shows a modified bottom portion of the apparatus of FIG. 22 showing soft pads for an individual to either stand on or sit on. The extensions at the bottom are shown slimmer than those in FIG. 22 for their greater ability to slide underneath cargo. End of extensions should be very slender and flexible.

A simple automatic pneumatic control system is shown in FIG. 25, applicable to apparatus 80, 90 and 100, which requires a single pneumatic switching valve by Fisher Controls to maintain air pressures in pillow 70 or 70', FIGS. 18 and 22, at the desired pressure setting. Consequently, different sizes of loads can be accommodated, since the air pressure within the pillows would remain constant automatically at the set air pressure.

In FIG. 25, tank 101, having higher pressure air, supplies air to enclosure or pillows 70 and 70', via gate valve 102 and pneumatic valve 103, No. 164 by Fisher, say 5 psi, and valve 103 will sense the pressure in pillow 70 via feedback hose 108. Valve 103 is partly a proportional device in that as the pillow pressure approaches 5 psi, the valve will begin to close, being completely closed when pillow pressure reaches 5 psi. Pillows 70 and 70' have two interconnecting tubings 106 and 107, connection 106 supplying air to both pillows, as shown. Also connection 107 helps maintain equal pressure in both pillows. Pillows, when inflated, help to securely retain a human being within the apparatus. Pressure gage 79 indicates to an individual the pillows' internal pressure. Air valve 72, similar to a auto tire valve, is connected to tank 101 and enables air to be pumped into the tank. Air relief valve 110 enables air to be released from the pillows, should the pressure exceed the pillows' design pressure. Valve 110 could have an adjustable setting.

Enclosure or pillows 70 and 70' could have handles for a person to hang on to, to be assured of his positive retention within the apparatus. Length L could be 5 Ft. and width W could be 3 Ft. for holding a man in place. Location of handles 105 on pillows may be at any convenient position, for a person inside apparatus 90 to hang on to with ease.

PILLOW EXTERIOR DESIGN FOR MORE SECURE HOLDING CAPABILITY FOR PERSONNEL

Figure 23:
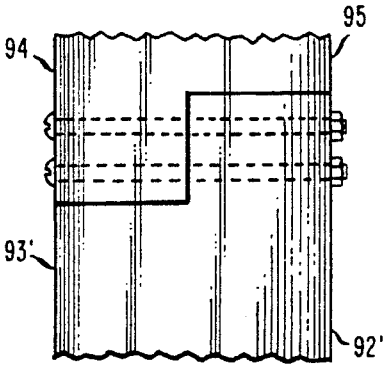
FIG. 23 is a side view thereof showing the elongated pillows and bolts holding together the upper and lower parts of the lower portions of the apparatus for disassembly of the apparatus for storage.

To accommodate individuals more comfortably and securely within the lower portions of the apparatus shown in FIG. 22, the inside exterior surfaces of inflatable enclosure or pillows 70' have concave shapes as shown in FIG. 22, apparatus 90. Numeral 112 points to an essentially uninflated pillow, while numeral 113 points to a fully inflated pillow. When inflated, the inside surfaces retain their concave shapes 113. When an individual is lying down prostrated, the lowest concave shape shown supports his body, as lower portion 92 and 93 come together for lift-off. The inflatable fabric or other material, engineered to the desired specifications, has a soft resilient surface, and is designed not to harm the person being lifted. Thus, a person can be quickly rescued from enemy territory; rescued from inaccessible mountainous areas, even when hurt and disabled; can be rescued from the roof of a burning building by helicopter or by a derrick. FIG. 23 shows a partial side view of the lower portion.

Figure 24:
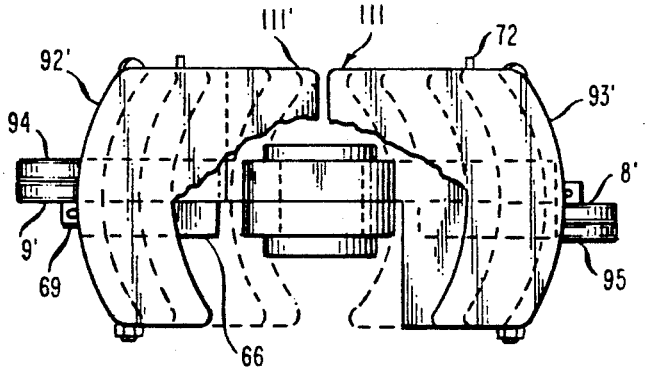
FIG. 24 is a bottom view thereof.

When an individual is in a sitting position, the middle concave shape of pillow 112 is utilized. The concave portion safely protects and holds his head and body securely and comfortably in position. When an individual wishes to stand, the uppermost concave shape 113 protects and holds his head securely and comfortably in position, while the other portions of the enclosure or pillow hold his body in position. If the individual is tall, then he may have to bend a little when standing up. A tall person may be more comfortable in a sitting position. FIGS. 24 shows a bottom view of the new design.

This apparatus shown in several figures could be fabricated as a modular device having interchangeable parts, so that for one particular application, say for snatching cargo, predetermined parts would be selected and assembled. For rescuing personnel, other parts may be specified and used, some of the parts being common to both applications, such as the upper portions, shown in the figures.

THE MOUNTING OF PILLOWS ON APPARATUS 90

Figure 20:
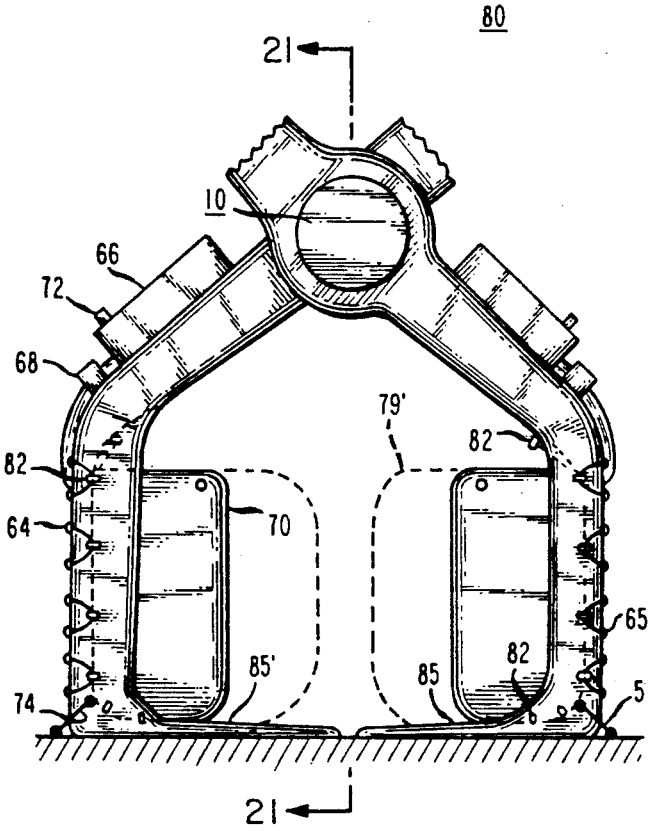
FIG. 20 shows a partial front view of the tongs-like device showing the inflatable bags for accommodating and retaining various sizes and shapes of cargo.
Figure 21:
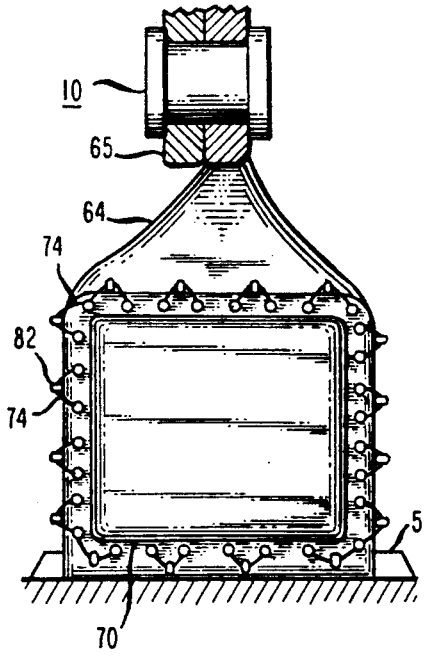
FIG. 21 shows a rectangular-shaped inflatable bag for fastening onto the inside surface of each lower portion of device. This is a sectional view taken along line 21—21 of FIG. 20.

FIG. 21 shows a sectional view along line 21—21 of FIG. 2 apparatus 80. Detailed information on the inflatable enclosure or pillow mounted on the interior lower portion is shown. Loops encircle hooks 82 to hold pillow 70 in position under environmental conditions. Loops 74 should be inspected periodically for wear. A worn loop should be replaced to assure that enclosure or pillow 70 will remain in position. It should be noted the number of loops shown in FIG. 21 does not agree with the number of loops shown on FIG. 11. Just the concept is being presented here. In the actual fabrication of the apparatus, loops may be used than shown in FIG. 11 or in FIG. 21. In FIG. 20, the loops of enclosure or pillow 70 are shown bent around the corner lower portions of 64 and 65, and fastened to hooks 82 which are located in the front side of apparatus 80. Dashed lines 79' the pillow fully inflated. The shape of the inflated pillow be different than shown in FIG. 20. The inflated pillow may more like a pot belly, as shown in FIG. 11A, than having a surface unless so forced by elastic bands. Bottom loops 74 of pillow 70 encircle hooks located extensions 85 and 85'. Top loops 74 of pillow encircle located underneath the inside of curved surfaces of portions 64 and 65, as shown. Enclosure or pillow 70 could be fitted plastic guide rods in its fabrication to force pillow to inflate to the desired shape.

ANOTHER PREFERRED EMBODIMENT FOR PERSONNEL

Figure 27:
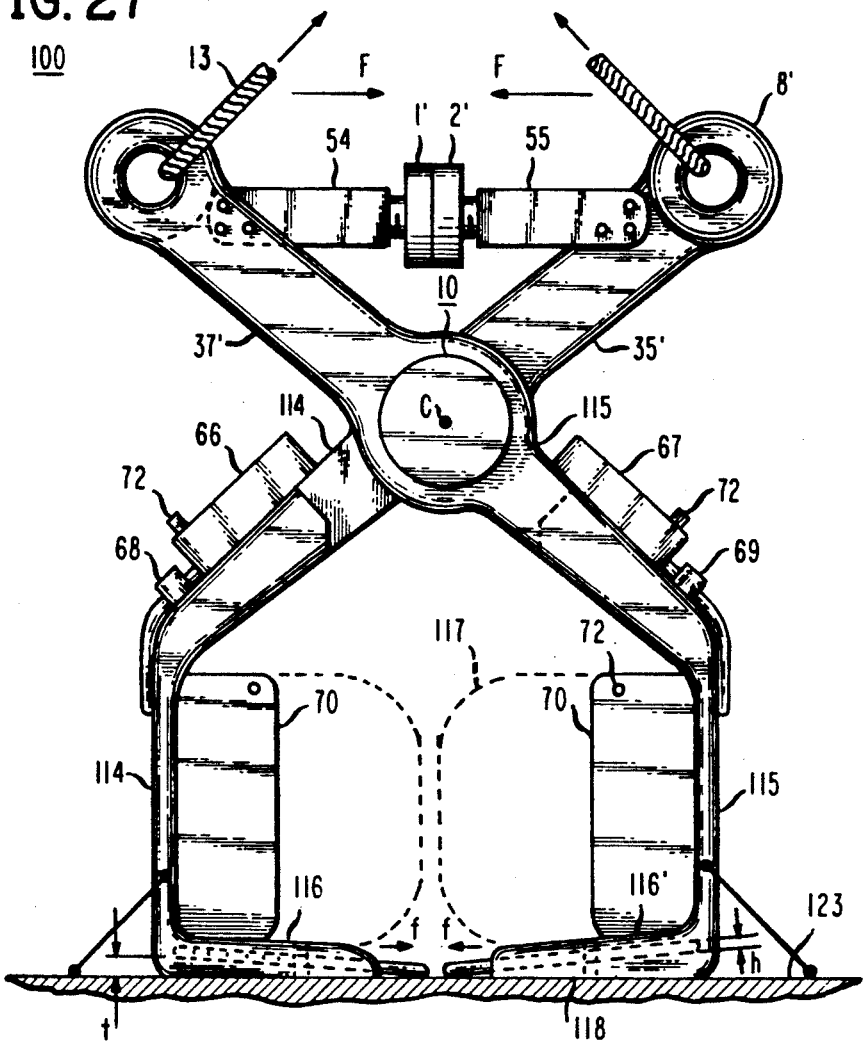
FIG. 27 shows the apparatus of FIG. 18 with the added feature of retractable bottom extensions that have tongues protruding toward the center by compression springs. An individual's body in contact with the ends of the tongue would cause any tongues in contact to retract.
Figure 28:
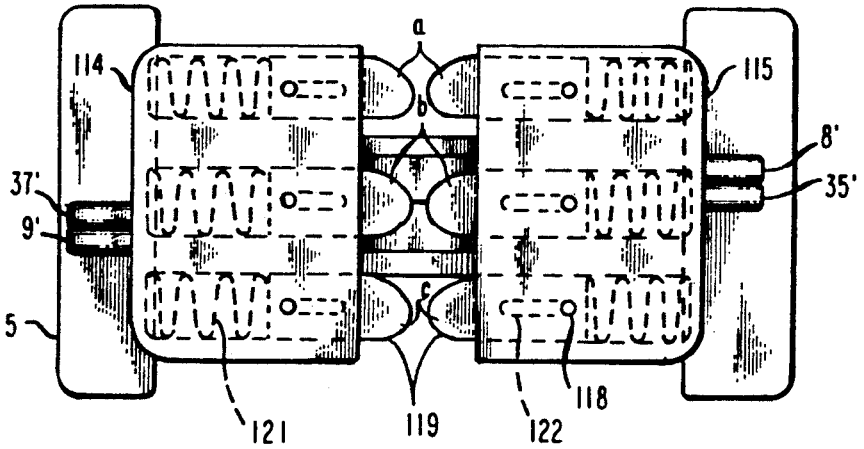
FIG. 28 shows a bottom view thereof.

Apparatus 100, shown in FIGS. 27 and 28, has been modified for scooping up personnel and cargo, too, without damaging or hurting either the individual or the cargo.

Tongues 119 on FIG. 28, extending toward the center or middle, are capable of being pushed inward into elongated recesses toward the exterior of the apparatus, against compression springs 121, so that the load scooped up will not suffer injury or damage. Tongues 119 are retained within the rectangular openings, shown by dashed lines, FIGS. 27 and 28, by pins inside slots 122. Pins 118 are held in position by extensions 116 and 116'. Slots 122 are located in tongue 119. Hence, the tongues' movements are limited by the length of slots 122. Spring 121 may be a coil spring of height h. The recesses and tongues slope downward to be better able to scoop underneath a person's body, without hurting him, as shown in FIG. 27. The spring's thickness would be governed by the strength of spring desired for the type and weight of load scooped up. Actually, the force with which tongues 119 come together when apparatus 100 is lifted, would depend on the net torque about center C of pivot pin 10 produced by weights 8' and 9', the distribution of the weights of the upper and lower portions of the apparatus and the weights of any shackles, not shown, that may be attached to the holes of weights 8', 9', and the dynamic forces produced by the acceleration of gravity. The total force f imposed by the above net torque on an individual either sitting or lying down may be from 10 to 20 Lbs. The strength of each spring 121 should be less, not to exceed 3 to 5 Lbs. for the entire length of travel of tongues 119 within their rectangular openings, so that the individual would not be harmed. To be sure, one would need to experiment with individuals of various ages and injuries. Let us assume that the individual is lying down, and lower portions 114 and 115, including extensions, straddle him, as apparatus 100 is lifted. Tongues "a" may get underneath an individual. tongues "b" may not, but tongues "c" also may get underneath individual. Tongues "a" and "c" should be sufficiently sturdy to lift individual from surface 123 to a place of safety. Brackets 5 and 5' provide supplementary stability to apparatus 100 to maintain uprightness upon touchdown.

The greater the number of tongues, within limits, the greater the chances of more tongues getting underneath the individual being rescued, assuming that the individual is unconscious or so disabled as to be unable to crawl onto extensions 116 and 116' on his own power. Distance t, FIG. 27, should be as thin as practical and feasible so tongues 119 can get underneath an individual or under a lightweight load.

The material used for the tongue could be high impact resilient plastic, while the material for extensions 116 and 116' could be light-weight, high strength titanium, or a high strength plastic composite, as used in army aircraft. Brackets 5, 5' help apparatus 100 maintain uprightness.

If the individual is able to crawl onto the apparatus' lower portions, then, before lowering apparatus 100, chain 124 with a safety hook, similar to hook 82, FIG. 27, could be placed between lower portions 114 and 115, to prevent lower portions from separating. This way the individual would not be in danger of being further injured by the two extensions 116 and 116' coming together to scoop him up. The top surfaces of the extensions could be padded for his comfort. Pillows 70 could have handles for him to hang on to. In FIG. 27, pillows 70 are in partial inflation, while dashed lines 117 show the pillows fully inflated. The amount of inflation would depend upon the size, weight and condition of the individual or person, and the pressure would be controlled by the setting of a pressurestat.

When scooping up an individual, lying down or sitting, a safe way to rescue him is to approach him either at his feet end or at his head end. The apparatus would be allowed to make contact on the surface ahead or behind him; then the apparatus' tongues would be made to slide underneath the individual. When the ends of tongs 119 are underneath the individual, then hoist cables 13 and 14 are slowly pulled up almost vertically, causing lower portions 114 and 115 to come together until hammerheads 1' and 2' make contact. Now the individual is snugly and securely embraced by inflated pillows 70, as he is rescued and transported to a safe location, either by helicopter, by a derrick or by some other means.

DESCRIPTION OF A PREFERRED EMBODIMENT TO IMPROVE PERSONNEL SAFETY

Lifting apparatus 120 is still another improved, preferred design over any of the previously described ones. Like FIG. 22, it is a scooping and releasing structure. It is capable of automatically scooping up an individual lying down. Further experimentation may be needed to refine the design, but the essential features are shown in the design illustrated in FIGS. 29, 30 and 31. The differences from the design shown in apparatus 90, FIGS. 22, 23 and 24 are: 1. Air pressure tanks 66 and 67 have been eliminated. Instead, double, back-to-back pillows 126, 128 and 127,128; have been substituted. Pillows 128, 128' are compartmentalized because of the possibility of losing pressure in the entire pillow, should accidental piercing occur, should the pillow not be subdivided into compartments. In addition, pillows 128, 128', which look like mattresses, could be considered back-ups for inflated pillows 129, 129' should either one lose its air pressure. 2. To reduce the weights of upper portions 94 and 95, extension springs 135 and 136 are added, to aid in automatically separating lower portions 92' and 93', upon touchdown of apparatus on a surface below. 3. Handle 130 with grips 131 and 131 $\propto$ 0 at pivot pin 10' is provided for an individual sitting or standing within the space of the lower portions to grasp while being lifted or lowered onto a platform or surface below. 4. In FIG. 30, a central cut-out 132 is provided within extensions 133 and 134 to allow an individual to stand inside of the cut-out, thus permitting lower portions 92' and 93' to be separated with the aid of springs 135 and 136. An individual also should temporarily hang on to grips 131 and 131'. When lower portions are separated, the individual would walk away from beneath apparatus 120. Hoist equipment above would gradually lift apparatus away from the area, to be used again. 5. When apparatus 120 must accommodate two individuals, one to aid in rescuing a disabled one and the other the disabled, chain 124 would be used to prevent the lower portions from separating. Even if a single individual is within the lower portions' enclosure, it may be desirable to use the chain in severe environmental conditions, to avoid accidental separation of the lower portions. The disabled individual or person could be placed on top of padded extensions 133 and 134 and the rescuer could stand upright, holding on to grips 131 and 131' with his feet straddled around and outside the disabled individual, so that the disabled one would lie between his feet. When apparatus 120 makes touchdown on a safe site, chain 124 would still prevent lower portions from separating, allowing the rescuer to remove the disabled one from within lower portions 92' and 93'.

Figure 29:
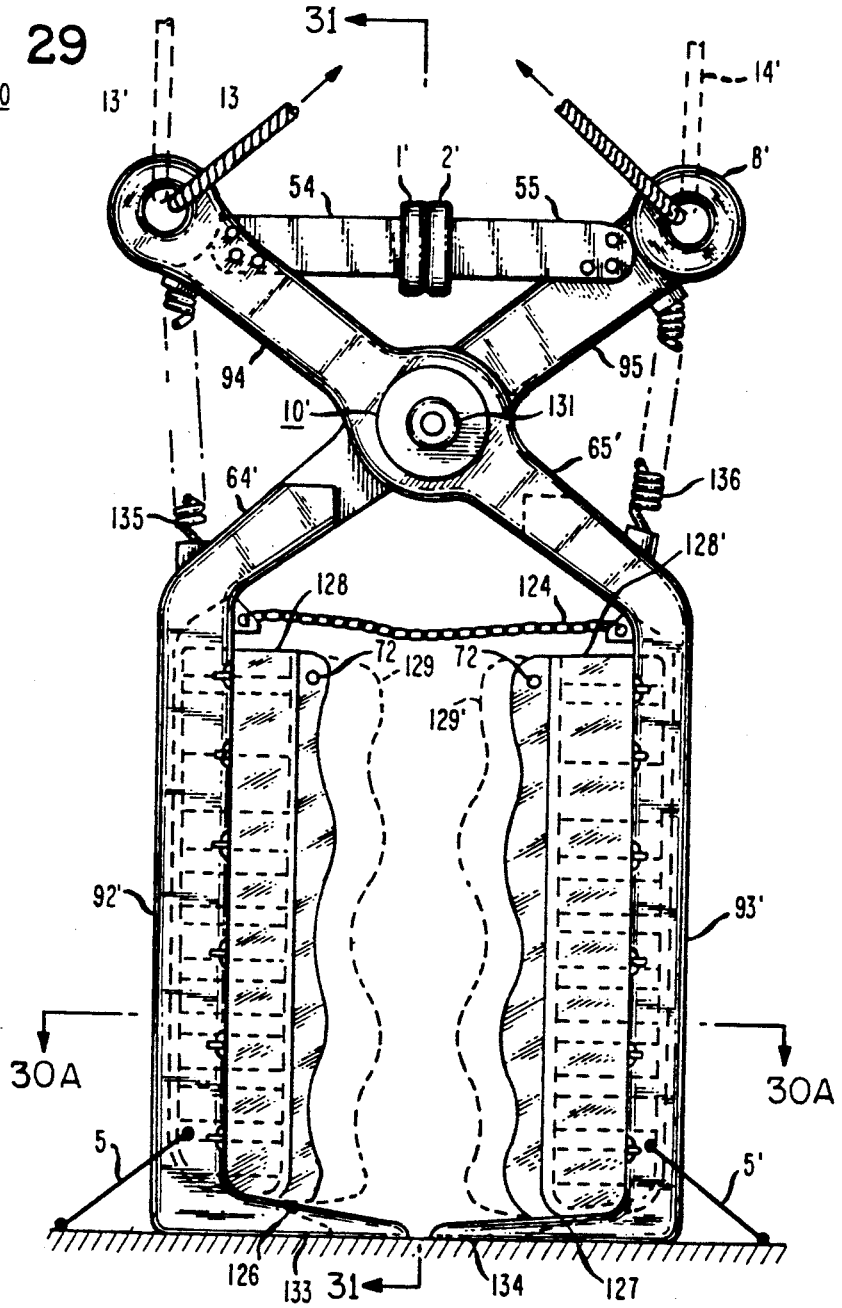
FIG. 29 shows the apparatus of FIG. 22, but without the two pressure tanks and with two elongated pillows back-to-back against the inside wall of each lower portion. A chain also is added for use when wanting to prevent the lower portions of apparatus to separate.
Figure 30:
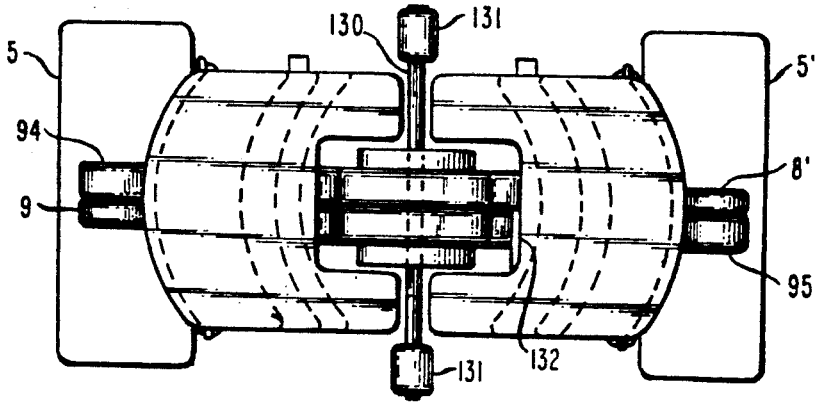
FIG. 30 is a bottom view thereof showing the rectangular cut-out in the extensions at the apparatus' bottom.
Figure 31:
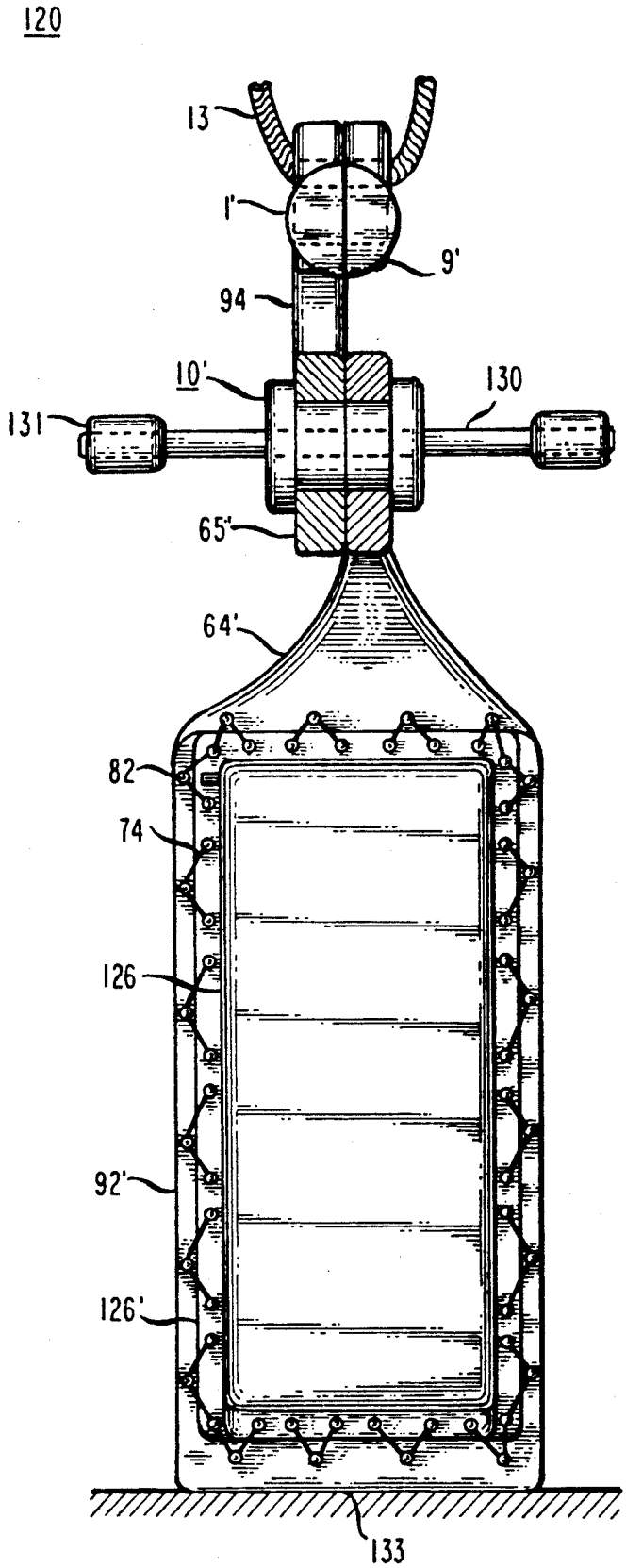
FIG. 31 shows a sectional view along line 31—31 of FIG. 29, showing the hand-grips above at the pivot pin and also the fastening method of the elongated pillow to a lower portion's inside wall.
Figure 30A:
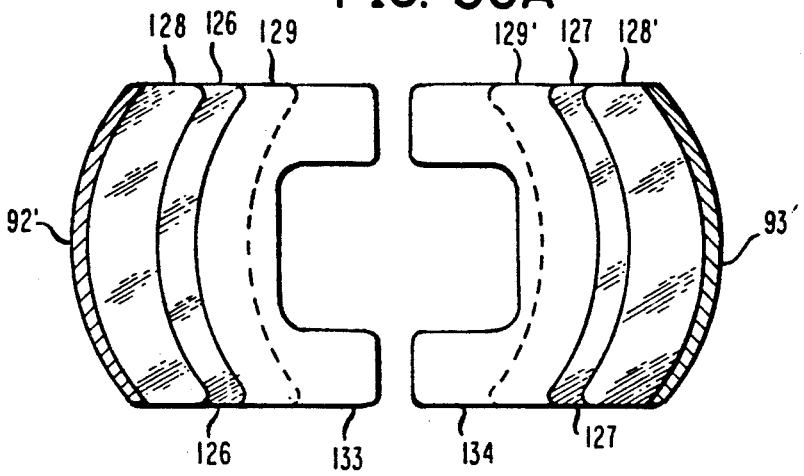
FIG. 30A shows a sectional view taken along 30A—30A of FIG. 29, showing the thickness of the lower portions' walls and the cut in the bottom of the apparatus.

In other respects, design represented in FIG. 29, apparatus 120 is similar to FIG. 22, apparatus 90.

Wire brackets 5 are added to apparatus 120, similar to those shown in apparatus 100 to help apparatus 120 maintain its uprightness upon touchdown on a supporting platform 134. As in apparatus 100, bracket 5 is bent into a rectangular shape, with its cylindrical ends inserted into circular holes at the sides of lower portions 92' and 93'. To reduce friction, Oilite bushings with closed ends, as bearings, are inserted in the holes. If the wire is springy, then it will stay in place. If strengthening is needed, then slender rods 5'' may be added to the wire bracket, as shown in dashed line, FIGS. 30 and 31.

DESCRIPTION OF ELONGATED PILLOWS

Figure 32:
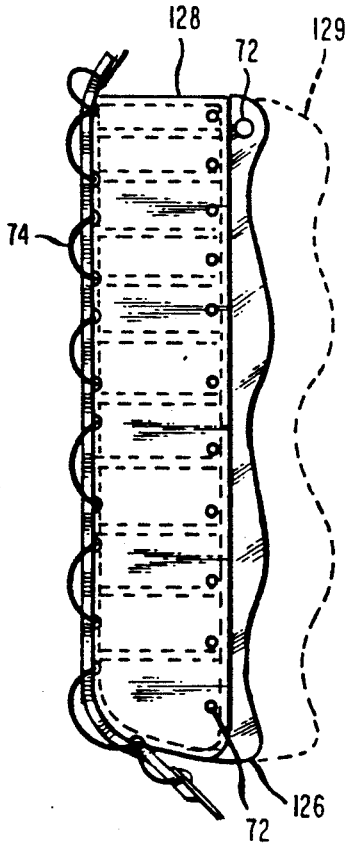
FIG. 32 shows a side view of the two inflatable, elongated pillows by themselves, fastened or cemented to each other, one with compartments and the other without compartments.
Figure 33:
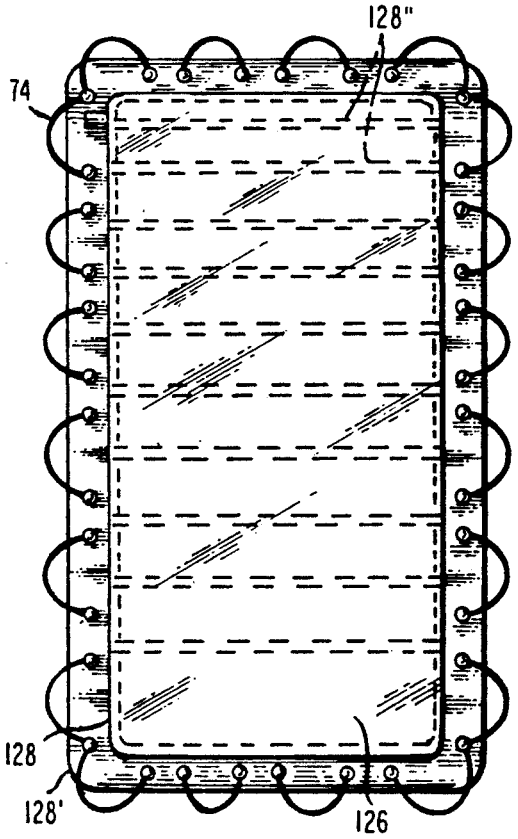
FIG. 33 shows a front view of the same elongated pillows showing the loops along the first pillow's periphery for attachment to the inside wall of a lower portion of the apparatus.
Figure 10:
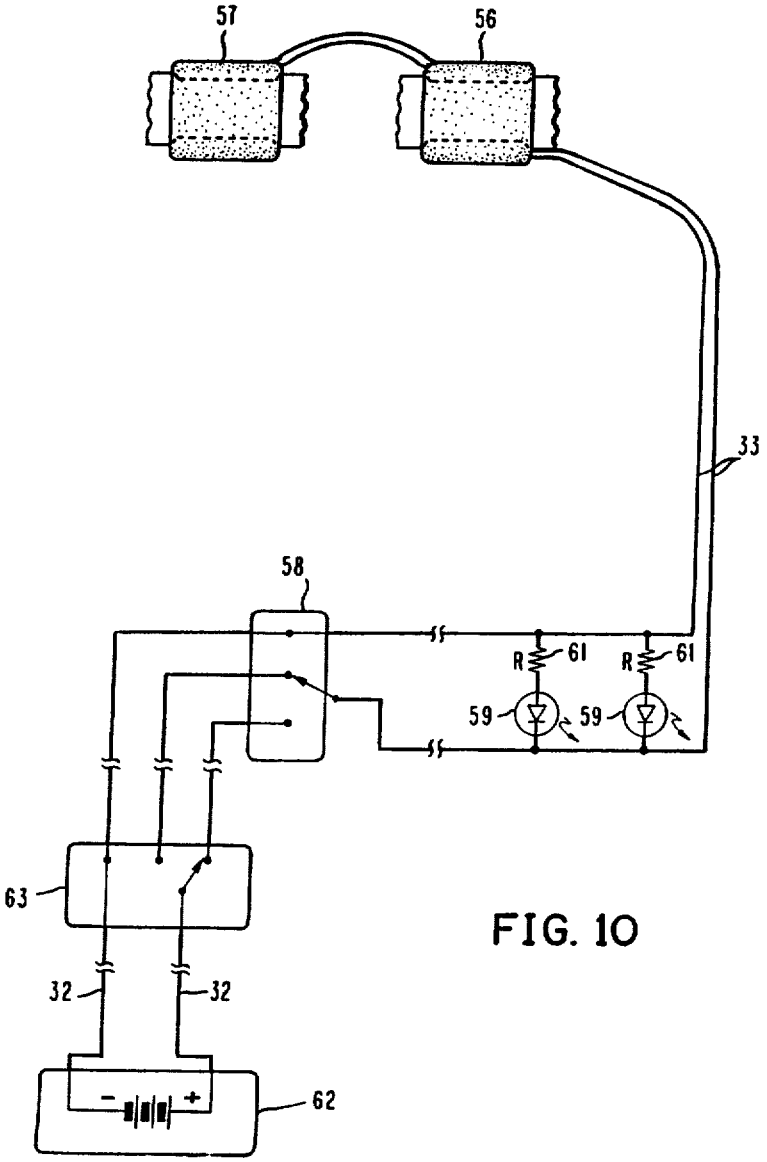

In FIGS. 32 and 33 the pillows for supporting personnel and cargo have been shown by themselves, while in FIGS. 29 and 30, apparatus 120, the pillows are shown as part of the apparatus. In FIG. 32, pillows 126 and 128 may be rubber-cemented or otherwise held together so that the pillows may not be separated from each other, such as held together by straps, not shown to avoid complicating the drawing. Pillow 128 is compartmentalized; the pillow has been subdivided into eleven airtight compartments with each compartment having its own air valve. The reason for the compartments is to provide additional safety for the individual being lifted. Should a compartment of elongated pillow 128 be pierced, ruptured or ripped apart, only one small portion of pillow 128 would be affected; the remaining ten compartments would be able to snugly embrace and retain the individual. The purpose of elongated pillow 126 is to have sufficient air pressure within to accommodate the individual or cargo snugly and securely. This second pillow has a single air valve; introducing air through this valve inflated the entire pillow. The pillow's exterior is designed to have the wavy shape shown, identified by numeral 29, FIGS. 29 and 32, in order to provide air pockets for the individual to breathe, as well as to snugly embrace him, while being lifted by hoist cables 13, FIG. 29. Pillow 128 could have more waves, or crests and troughs, to assure that the individual would be held in place and have sufficient air pockets for breathing, than are shown in FIG. 32. The pillow's design with plastic reinforcing ribs, not shown, would force the pillow to assume the wavy profile shown in FIG. 126. Numeral 128" points to air tight rubberized inflatable seals between compartments. All compartments could be of the same size.

Another advantage to having double pillows 126 and 128 is that pillow 128 could be removed in order to accommodate a very large individual or a larger size containerized cargo. An alternative is to leave pillow 128 uninflated by removing all of its air.

DESCRIPTION OF A PREFERRED EMBODIMENT WITHOUT AUTOMATIC SNATCHING CAPABILITY

Apparatus 150 has the appearance of lower portions 92 and 93, FIG. 22, apparatus 90; however, its upper portions and pivot pin are omitted. This configuration is desirable when automatic snatching of cargo and personnel is unnecessary, thus simplifying the design. Dashed lines 145 and 146 point to hoist cables that may be attached to the upper parts of apparatus 150 to lift and transport it either by helicopter or by derrick to a desired site. Then, instead of cables, rotor and engine 143, also shown in dashed lines, may be used and attached to the upper parts of apparatus 150, enabling it to be independent of supporting hoist equipment. A suggested outline for the rotor and engine is shown superimposed over the cables and shown in dashed lines in FIGS. 35 and 36. Cover 147 protects individual.

As in apparatus 90, apparatus 150 consists of two halves, 136 and 137. Half member 137 has inflatable, partioned pillow 140, attached to its inside wall, with inflatable elongated pillow 139 fastened firmly to the exterior surface of pillow 140. Note that exterior of pillow 139 is constructed with a wavy shape with crests and troughs, so it can snugly embrace an individual more comfortably, holding him safely even under severe environmental conditions while suspended.

Now referring to partioned pillows 140 and 140', note that each compartment has an air valve 72', FIG. 34. Compartments are separated from each other by seal 144, so that should pillow 140 be pierced, only one compartment would be affected and lose its air pressure. Thus, the person embraced by the pillows would still be held safely in position within the apparatus. However, should either elongated pillow 139 or 139' be pierced, the entire pillow would lose its pressure, unless it, too, were partioned. The individual would still be embraced by the remaining pillows but not as snugly. Then the individual could hang on to either horizontal bar 141', if standing, or bar 141, if seated, should the need arise. Bars 141 and 141' are prevented from coming off of knobs 142 by leaf spring 183, illustrated in FIG. 31.

Pillows 139 and 139' have air valves 72, for introducing air pressure. FIG. 35 is a sectional view taken along line 35—35 of FIG. 34, showing the manner in which pillow 139 is fastened to the inside wall of portion 136. It is fastened by loops 74 and hooks 82, similar to the way in which pillow 70, FIG. 21, is fastened to inside wall 64, FIG. 20, apparatus 90. No air tanks 66 are suggested for the pillows of apparatus 150.

FIG. 36 is a bottom view of apparatus 150 showing bottom extensions 133' and 134' making contact. The extensions could be padded for the individual's comfort, as shown in dashed lines, FIG. 26.

Bars 141 and 141' hold the two halves of apparatus 150 together and extensions 133' and 134' assist in keeping the halves separated.

Wings or stabilizers 151 are added and attached to the four bottom corners of apparatus 150 to assist in stabilizing lower portions 136 and 137 in an upright position when sitting on a platform, to provide supplementary stabilization. Stabilizers 151 should be lightweight plastic or composite. A suggested supplier of composites is Emerson & Cuming Inc. Each wing 151 is securely fixed to each corner of each lower portion 136 and 137, the bottom or underneath surface of each wing being flush with the bottom surface of each extension or projection 133' and 134'.

I claim:

1. An automatically-actuated lifting apparatus, capable of scooping up and unloading various sizes and shapes of containerized cargo and personnel from a supporting platform automatically, comprising a structure having two elongated lightweight members with upper and lower portions having inside surfaces, said portions pivoted at a selected distance from the top end of said apparatus with a pivot pin, for use with hoist cables, being adapted for attachment to said upper portions having weights on top and having less width than said lower portions, said lower portions being vertical and curved on their insides for engaging said cargo; each of said upper portions having a bar inwardly-extending from its inside surface, each bar having a hammerhead at one end, and each said hammerhead extending inward toward each other, said hammerheads, when abutting, receiving the major structural compressive stresses imposed by the horizontal components of said hoist cables, when supporting said cargo, said hammerheads being adjustable in length to permit variations in the separation between said lower portions when engaging various size loads, therby said cargo being spared possible damaging compressive forces; said lower portions being of sufficient large size in width and height to scoop up cargo within specified limits in their dimensions; wherein the improvements to said lower portions including having extended protrusions with selectively sharp ends at their bottoms extending a selected distance toward the apparatus' horizontal center; for automatic space adaptability to said various sizes and shapes of cargo, said lower portions having inflatable, air-tight, lightweight pillows attached firmly to said inside surfaces, said pillows having no air supplies external to said apparatus, said pillows to engage said cargo when said lower portions come together on lift-off of said apparatus, said pillows shaping themselves to securely embrace said cargo's shape and size, thus firmly holding said cargo within said curved inner walls of said lower portions while suspended in air, said protrusions capable of supporting the weight of said cargo, said ends assisting in snatching and lifting up said cargo.

2. An automatically-actuated lifting apparatus as in claim 1, and wherein an air overflow tank connected to each of said pillows with hoses being included, said tank being capable of holding air at a higher pressure than said pillow; one or more flexible hoses connecting each tank to one of said pillows to allow air to flow either into a pillow or into a tank from a pillow, when air pressure in said tank is less than pillow pressure; each hose also being fitted with a shut-off valve; each of said pillows being fitted with an air valve for pumping air into a pillow; when said tank having higher pressure air to supply air to said pillow when needed, for each of said pillows to securely hug and embrace heavy cargo; each of said pillows also having an air relief valve to allow air to escape from each of said pillows to prevent air pressure inside a pillow to exceed its design limit in value; said shut-off valve being opened also when air pressure in said tank is lower than pillow air pressure so excessive air can be conserved by allowing said air to flow into said tank, to be reused at a later time when additional air is needed in a pillow, thus, apparatus is not dependent on air supply from a source external to itself; the air being supplied via said tank by manually allowing air to flow through said valve.

3. An automatically-actuated lifting apparatus as in claim 1, and wherein an air-pressurized tank being provided, and having hose connections to each of said pillows by means of flexible hoses via a gate valve and a pneumatic switching valve with air feedback from at least one of said pillows and preset pressure capability, said tank capable of holding air at a much higher pressure than said pillows, said switching valve's opening depending on the air pressure preset for at least one of said pillows, said switching valve closing completely when said pillows' pressure reaches said set pressure, said pillows and said tank provided with air valves for pumping air into said tank and into said pillows from an exterior source, said preset pressure to be of such a value as to keep said cargo securely and firmly in place within said lower portions of said apparatus; thus, preset pressurized air being provided automatically to said pillows for pillows to securely hold cargo in place, even when said apparatus is suspended and exposed to wind gusts.

4. An automatically-actuated lifting apparatus as in claim 3, and wherein said apparatus' lower portions being designed to scoop up a person automatically from a dangerous area, and wherein a handle is provided and securely attached to each of said pillows, said pillows having selectively-shaped forms on said exposed exterior surfaces, with sufficient air pressure, to securely keep said person in place within said lower portions without in any way injuring or suffocating said person; said handle being provided for an individual to grasp for additional security from falling off while being lifted to safety under harsh environmental conditions; said pillow' shaped forms having one or more concavely-shaped exterior surfaces to accommodate and securely hold a person either standing or lying down, without being suffocated from lack of air.

5. An automatically-actuated lifting apparatus in accordance with claim 4, and wherein said two lower portions have a chain, with each of two ends stretched and fastened between said lower portions with a hook at one end for engagement, said chain to prevent said lower portions from separating while either suspended or at touchdown on said platform; thereby for loading, an individual could either crawl onto or walk in and stand on said projection without being concerned about said lower portion coming down on him; then upon touchdown of said apparatus for loading, an individual could either crawl out under said chain or unchain and walk out, stooped if necessary, onto said platform.

6. An automatically-actuated lifting apparatus in accordance with claim 4, and wherein said two lower portions have bottoms, and projections protruding inward from said bottoms, said projections having two or more tongues also extending inward toward the center of said lower portions, at the end of each of said projections, means being provided for receding said tongues when in contact with a person, said means being coiled springs in elongated recesses within said projections; said tongues restrained in movement to prevent their falling out of said openings and to prevent opposing tongues from making contact; thereby with said tongues capable of retracting, thus said person being more protected from possible injury by the ends of said tongues.

7. An automatically-actuated automatic lifting apparatus as in claim 1, and wherein each of said elongated members being constructed of two or more sections to enable said apparatus to be taken apart and be stored inside a storage compartment of an aircraft, said sections having tongue and groove ends which fit snugly together and being securely fastened together with bolts, so that no movement exists between said sections when assembled, for reduced storage-space-requirement.

8. An automatically-actuated automatic lifting apparatus as in claim 7, wherein said sections enabling said apparatus to be taken apart, having just a single tongue at said ends which fit together, said single tongue being fastened securely to another single tongue by means of bolts, so that no movement exists between said sections when assembled, for reduced storage-space-requirement when apparatus not in use.

9. An automatically-actuated lifting apparatus in accordance with claim 1, and wherein stabilizing means is provided to furnish supplementary stabilization of said lower portions in an upright position on a supporting platform, so apparatus will remain upright even on a slightly uneven rigid surface.

10. A lifting apparatus in accordance with claim 9, wherein said cargo being a person and wherein said supplementary stabilization being a lightweight, sturdy, selectively-shaped form, swivelley secured to each of said lower portions, and having a straight segment making contact with said platform to assist in maintaining uprightness of said apparatus, as and when said apparatus makes touchdown on said platform; after touchdown said apparatus may be slowly slid into a position over said person by said hoist cables, so that said person may be readily scooped up by said lower portions of said apparatus, so that apparatus will remain upright even when platform may not be level, while said apparatus being slid into said position.

11. A lifting apparatus in accordance with claim 10, wherein said selectively-shaped form is fixed in one position, said position being one to most effectively stabilize said lower portions in an upright position on a platform, so apparatus will remain upright even on an uneven surface.

12. An automatically-actuated lifting apparatus, capable of automatically scooping up various shapes and sizes of loads, including a person, from a supporting platform, said apparatus comprising a structure having two, light-weight, elongated members with upper portions and lower portions, each of said lower portions having inside surfaces, said elongated members having a pivot means at a selected distance from the top of said apparatus, each of said upper portions being adapted for attachment to hoist cables, said upper portions having a biasing means for urging said lower portions to automatically separate upon touchdown of said apparatus into said supporting platform, said lower portions being substantially vertical when engaging said load, each of said lower portions having a bottom end with a projection extending toward the horizontal center of said apparatus; each of said upper portions also having an inwardly-extending bar from its inside surface, each bar having a hammerhead at one end, and each said hammerhead extending a selected distance toward an opposing hammerhead, said hammerheads adapted for abutting and receiving almost the entire structural compressive stresses imposed, as and when said hoist cables are supporting said load, said cables being fastened at the top of each of said upper portions, thereby said load being spared any possible damaging compressive forces; said lower portions having a light-weight inflatable mattress attached along each lower portion's inside wall surface, an inflatable air-tight pillow being firmly attached to the entire length of each of said mattress, said pillow being shaped on its exposed exterior surface to securely retain said load in place within said apparatus when pressurized by air, said mattress having elastic bands and lightweight plastic springs to retain its shape, said pillow's exterior surface to be wavy with at least one crest and one trough, to better assist in holding a load in place.

13. An automatically-actuated lifting apparatus in accordance with claim 12 and wherein said pivot means includes a pivot pin, said pivot pin having ends and a rod passing through its centered along its entire length, and extending beyond each of said ends of said pin, each extremity of said rod having a resilient grip for a person to grasp, particularly when said lower portions are about to separate at touchdown, thereby allowing said projections to separate, while said person hangs on to each said grip.

14. An automatically-actuated lifting apparatus in accordance with claim 12, wherein each said projection at the bottom of each of said lower portions has a cutout sufficiently large for a person's foot to pass therethrough and stand, thus allowing said lower portions to separate upon touchdown, while said person stands on said platform.

15. An automatically-actuated lifting apparatus in accordance with claim 12, wherein said two lower portions being adapted for attaching a chain there-between, said chain having two ends, and said chain having a hook at at least one end for disengagement of said chain from said lower portions, said chain adapted for preventing said lower portions from separating while either suspended or upon touchdown on said platform; thereby, a person could either crawl out of or crawl into the apparatus' free space of said lower portions, without fear of said portions separating from each other; said chain to be removed when automatic separation of said lower portions being desired.

16. An automatically-actuated lifting apparatus in accordance with claim 12, wherein said device has one or more extension springs to aid in separating said lower portions upon touchdown of said apparatus, and wherein each of said upper and lower portions has an exterior surface; each of said springs having one end fastened to the exterior surface of one of said upper portions and its other end fastened to exterior surface of a lower portion directly below that upper portion; each of said springs contracting when said apparatus disengages said cargo; whereby said springs' presence assisting said weights on top, thus reducing the needed magnitude of said weights; thereby also enabling the weight of said apparatus to be considerably reduce; the stronger the spring the faster the separation of said lower portions upon touchdown of said apparatus.

17. An automatically-actuated lifting apparatus in accordance with claim 12, and wherein said mattress being a first pillow having separate inflatable compartments, said first pillow attached along each lower portion's inside wall surface, said second pillow being shaped on its exposed exterior surface to hold a person comfortably in place, and adequately air-pressured to securely keep said person in place within said apparatus, each said first pillow having light-weight elastic strips for support and maintenance of its shape when inflated, said pillows shaping themselves to snugly embrace said individual's size and shape, said second pillow's exterior surface being shaped with crest and troughs, the head of said person being located in the pillow's trough in order not to smother said individual, said compartmentalized pillow holding its shape even when one of its compartments has been accidentally pierced, said second pillow having sufficient air pressure to accommodate the size of load embraced and securely keep it from being dislodged, said pillows with compartments providing safety for said load while being transported.

18. An apparatus in accordance with claim 12, and wherein modularization of said apparatus is provided by allowing said longer lower portions to be disconnected into pieces for convenience in storing said apparatus.

* * * * *

UNITED STATES PATENT AND TRADEMARK OFFICE

CERTIFICATE OF CORRECTION

PATENT NO. : 5,209,538

DATED : May 11, 1993

INVENTOR(S) : Edwin Z. Gabriel

It is certified that error appears in the above-indentified patent and that said Letters Patent is hereby corrected as shown below:

On the title page, under item [19] and item [76], change "Gabruel" to --Gabriel--.

Figure 10A:
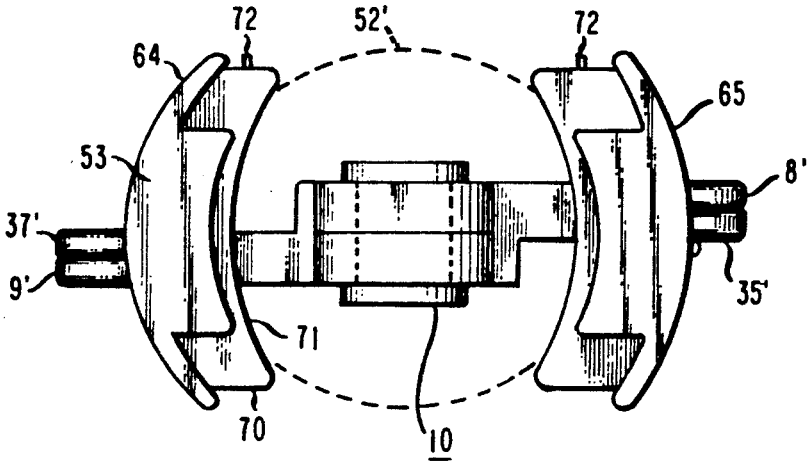

In the Drawings, drawing sheet 6 of 16 consisting of figures 10 and 10A should be deleted to be replaced with the attached sheet.

Signed and Sealed this

Fourth Day of October, 1994

*Attest:*

*Attesting Officer*

BRUCE LEHMAN

*Commissioner of Patents and Trademarks*

INVENTOR: E. GABRILL
SHEET 6 OF 16